US006650299B2

(12) United States Patent
Zhang et al.

(10) Patent No.: US 6,650,299 B2
(45) Date of Patent: Nov. 18, 2003

(54) ANTENNA APPARATUS

(75) Inventors: Xin Zhang, Ibaraki (JP); Tsukasa Hiruta, Ibaraki (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 09/907,458

(22) Filed: Jul. 18, 2001

(65) Prior Publication Data

US 2002/0021255 A1 Feb. 21, 2002

(30) Foreign Application Priority Data

Jul. 18, 2000 (JP) ..... 2000-222393
Jul. 18, 2000 (JP) ..... 2000-222394

(51) Int. Cl.[7] ..... H01Q 1/38; H01Q 13/10
(52) U.S. Cl. ..... 343/770; 343/797
(58) Field of Search ..... 343/767, 770, 343/797, 846

(56) References Cited

U.S. PATENT DOCUMENTS 4,922,263 A * 5/1990 Dubost et al. ..... 343/797
5,691,734 A * 11/1997 Davies ..... 343/797

* cited by examiner

*Primary Examiner*—Michael C. Wimer
(74) *Attorney, Agent, or Firm*—Foley & Lardner

(57) ABSTRACT

An antenna apparatus of the invention that consolidates a plurality of slot antennas offers a polarization diversity function and a simple construction of feed means, thereby attaining a small, sophisticated, highly efficient, and broadband-property antenna. The antenna apparatus has a pair of antenna elements 1 orthogonal to each other, the pair of antenna elements 1 being constituted by a slot 4 formed in a conductive plate 3 on a dielectric plate 2. The slot 4 has two linear portions 4*c*, 4*d* which extend straight with a predetermined width, a crossing 4*a* at which the two linear portions 4*c*, 4*d* cross orthogonal each other at the respective center in the longitudinal direction, and fan-shaped portions 4*b* that extend from the ends of each of the two linear portions 4*c*, 4*d* while expanding gradually than the width of the two linear portions 4*c*, 4*d*.

14 Claims, 28 Drawing Sheets

ANTENNA APPARATUS

FIELD OF THE INVENTION

The present invention relates to an antenna apparatus using a slot, and more specifically, relates to an antenna apparatus, which makes it possible to consolidate a plurality of slot antennas, has a polarization diversity function and a simple construction of feed means, and is small, sophisticated and highly efficient, and is capable of obtaining a broadband property.

BACKGROUND OF THE INVENTION

Antenna elements can be constructed by forming a so-called straight-line slot exhibiting a straight line on a conductive plate, the face of which being overlapped on a dielectric plate. Then, by feeding power from a signal source (source) to the slot, the electromagnetic field resonates in the slot to thereby radiate radio wave. The slot antenna (antenna apparatus) having such a kind of straight-line slot has excellent electric characteristics, and hence is used in a wide range of application.

The slot antenna, however, is used functionally as a single antenna, and it is difficult to use it as a polarization diversity antenna.

It is also difficult to arrange a plurality of slot antennas close to each other, due to a restriction such as antenna size, etc.

If a plurality of slot antennas is arranged in a space as small as being occupied by only one slot antenna, the electrical effect between antennas increases. Therefore, practical use of such an antenna consolidating a plurality of slot antennas has been difficult.

Moreover, at the time of realizing an antenna consolidating a plurality of slot antennas, simple construction of the feed mean, miniaturization, improvement in the performance and efficiency, and obtaining broadband property are important.

SUMMARY OF THE INVENTION

It is therefore an object of the present invention to provide an antenna apparatus, which solves the above problems, makes it possible to consolidate a plurality of slot antennas, has a polarization diversity function and a simple construction of the feed means, and is small, sophisticated and highly efficient, and is capable of obtaining a broadband property.

According to the first feature, an antenna apparatus comprises a pair of antenna elements constituted by forming a slot on a conductive plate overlapped on a dielectric plate, wherein the pair of antenna elements orthogonal of each other is constituted by forming a slot having a crossing at which two linear portions extending straight with a predetermined width cross at right angles, at the center in the longitudinal direction to each other, and having fan-shaped portions at opposite ends of each linear portion, expanding gradually than the width of the linear portion.

A first feeder line forming an angle of +45° with respect to one linear portion and a second feeder line forming an angle of −45° with respect to this linear portion are provided along the dielectric plate so as to pass through the crossing, respectively, and in the vicinity of the crossing, one feeder line may be arranged on one face of the dielectric plate and the other feeder line may be arranged on the opposite face of the dielectric plate.

A reflecting plate consisting of a conductor may be provided with a predetermined distance separated from a face opposite to the face of the dielectric plate where the conductive plate is overlapped.

An electric characteristic adjusting plate consisting of a conductor may be provided with a predetermined distance separated from a face opposite to the face of the conductive plate overlapping on the dielectric plate.

A slot may be formed in the electric characteristics adjusting plate.

A plurality of the pairs of antenna elements may be provided on the conductive plate.

The plurality of pairs of antenna elements provided on the conductive plate may be arranged in series.

A feeder line may be provided for feeding power in parallel to each of the plurality of pairs of antenna elements.

According to the second feature, an antenna apparatus comprises a pair of antenna elements constituted by forming a slot on a conductive plate overlapped on a dielectric plate, wherein the pair of antenna elements is constituted by forming a slot having a shape such that two linear portions extending straight with a predetermined width cross at right angles, at the center in the longitudinal direction of each other, and a first feeder line forming an angle of +45° with respect to one linear portion and a second feeder line forming an angle of −45° with respect to said linear portion are provided along said dielectric plate so as to pass through said crossing of said two linear portions, respectively, and in the vicinity of said crossing, one feeder line is arranged on one face of said dielectric plate and the other feeder line is arranged on the opposite face of said dielectric plate.

The present invention exhibits excellent effects as described below.

(1) Since slots are formed such that slots comprising a linear portion and a fan-shaped portion at the end thereof cross each other in a shape of a cross, the polarization diversity function can be provided.

(2) Since two feeder lines are arranged on the front face and on the back face of the dielectric plate at the crossing, the construction of the feed means becomes simple.

(3) Since two linear slot antennas are arranged so as to cross each other, two slot antennas are consolidated in the same space, thereby enabling space saving, that is, miniaturization.

(4) Since two linear slot antennas are arranged in a perpendicular alignment, thereby enabling improvement in performance, such that the influence to each other becomes small, high S/N ratio can be obtained, and directivity becomes wide.

(5) Since the reflecting plate is arranged, a highly efficient antenna can be realized.

(6) Since the electric characteristics adjusting plate is installed, broadband property can be obtained.

DESCRIPTION OF THE PREFERRED EMBODIMENTS

One embodiment of the present invention will now be described in detail, with reference to the accompanying drawings.

Figure 1:
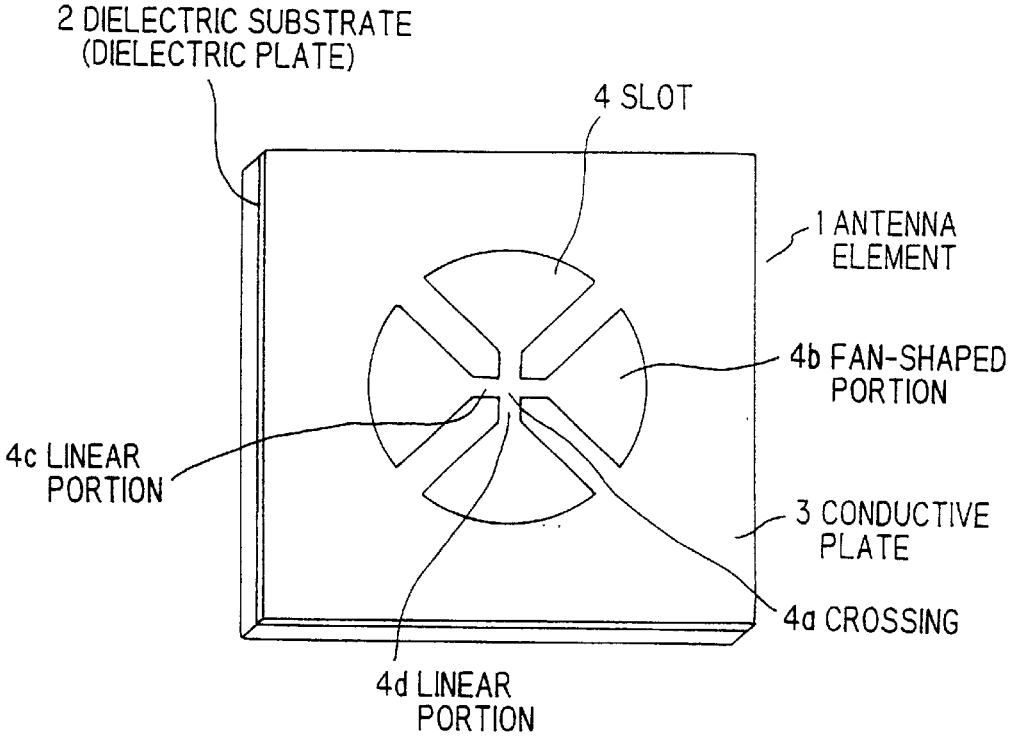
FIG. 1 is a perspective view showing an antenna element in a preferred embodiment of the present invention.

The antenna apparatus of the present invention uses an antenna element shown in FIG. 1. This antenna element 1 is constructed by forming a slot 4 having a crossing 4*a* in a shape of a cross at which two linear portions 4*c*, 4*d* having the same length and extending straight with a predetermined width cross at right angles, at the center in the longitudinal direction to each other, and having fan-shaped portions at opposite ends of each linear portion 4*c*, 4*d* expanding gradually than the width of the linear portions 4*c*, 4*d*, on a conductive plate 3 overlapped on one face (referred to as "front face") of a dielectric substrate 2.

Describing the shape in detail, the dielectric substrate 2 is a square, and the conductive plate 3 is also a square having the same size. The slot 4 is provided so that the linear portions 4*c*, 4*d* are in parallel or at right angles with respect to each side of the dielectric substrate 2, and the crossing 4*a* is located at the center of the dielectric substrate 2. The fan-shaped portions 4*b* have such a shape that the sides have an opening angle of 90°, and the outer periphery is a circular arc. That is, the fan-shaped portions 4*b* are formed in a sector. Hereinafter, the fan-shaped portion 4*b* is referred to as "fan-shaped portions 4*b*". The fan-shaped portions 4*b* is connected to the linear portions 4*c*, 4*d*. The side of the fan-shaped portions 4*b* has an inclination of ±45° with respect to the linear portion 4*c*. The conductive plate portion that separates the fan-shaped portions 4*b* is located in the diagonal line of the dielectric substrate 2.

This fan-shaped portions 4*b* may be triangular rather than a sector.

Figure 2:
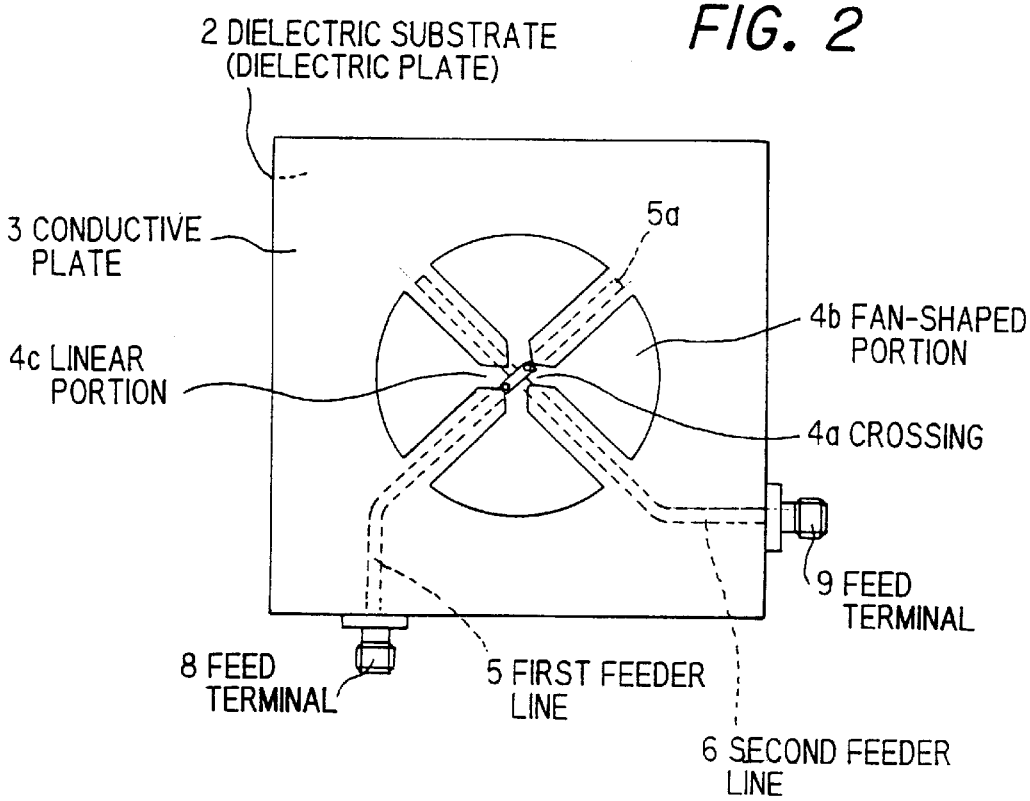
FIG. 2 is a plan view showing an antenna apparatus using the antenna element in FIG. 1.

The antenna apparatus using the antenna element shown in FIG. 1 is provided with, as shown in FIG. 2, a linear first feeder line 5 forming an angle of +45° with respect to one linear section 4*c*, and a linear second feeder line 6 forming an angle of −45° with respect to this linear section 4*c*. These first and second feeder lines 5, 6 are introduced at right angles with respect to each side from feeder terminals 8, 9 provided on two sides of the dielectric substrate 2, and bent at the diagonal line of the dielectric substrate 2, so as to pass through the crossing 4*a*. For the feeder terminals 8, 9, for example, a coaxial connector is used, so that the internal conductor of the coaxial connector is connected to the feeder lines 5, 6 and the outside conductor is connected to the conductive plate 3.

Figure 3:
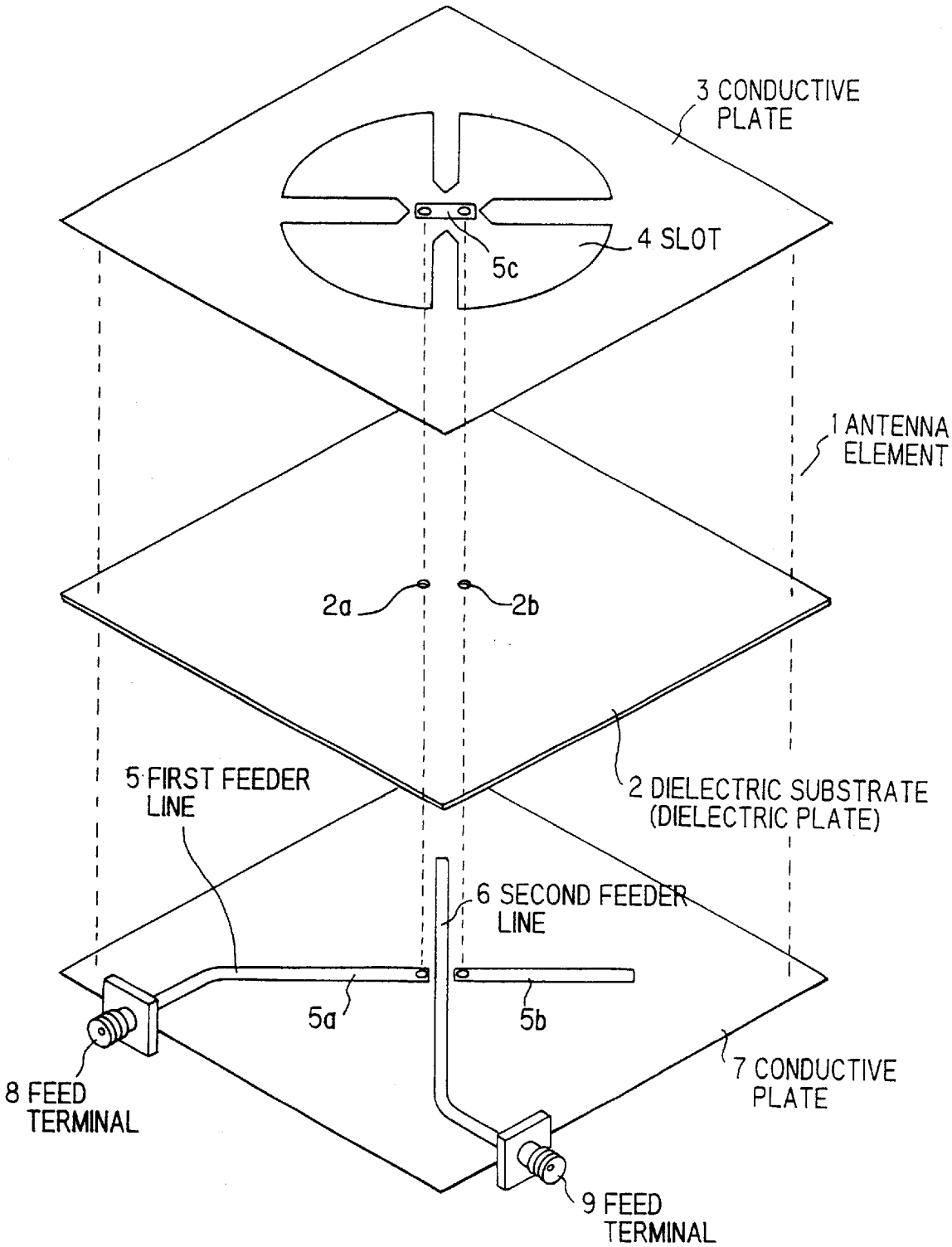
FIG. 3 is a broken view showing the antenna apparatus in FIG. 2.

As shown in FIG. 3, the first feeder line 5 and the second feeder line 6 are arranged along the dielectric substrate 2 on the face (referred to as "back face") opposite to the face of the dielectric substrate 2 where the conductive plate 3 is overlapped. The first feeder line 5 is divided into a feeder line 5*a* and a feeder line 5*b* at the position of the crossing 4*a*, and the second feeder line 6 passes between these divided feeder lines 5*a*, 5*b*. On the dielectric substrate 2, there are provided through holes 2*a*, 2*b* having a conductivity, at the position where the feeder lines 5*a*, 5*b* are divided, and on the conductive plate 3, there is provided a conductive jumper 5*c* spanning over the through holes 2*a*, 2*b*. Actually, the conductive plate 3, the dielectric substrate 2 and the feeder lines 5*a*, 5*b*, 6 closely overlap on each other, and hence the feeder line 5*a*, the through hole 2*a*, the jumper 5*c*, the through hole 2*b* and the feeder line 5*b* are conducted to thereby form the integral first feeder line 5.

The specific manufacturing method of this antenna apparatus is such that a printed circuit board in which conductive plates (conductive foils) 3, 7 comprising copper, aluminum or the like are formed on the opposite sides of the dielectric substrate 2 is used, the conductive foil 3 on the front face of this printed circuit board is etched to thereby form the slot 4 and the jumper 5*c*, and the conductive foil 7 on the back face thereof is also etched to thereby form the divided feeder lines 5*a*, 5*b* of the first feeder line 5 and the second feeder line 6. Then, the through holes 2*a*, 2*b* are connected and the feeder terminals 8, 9 are attached.

Next, the operation of this antenna apparatus will be described.

In this antenna apparatus, the slot 4 has a shape such that fan-shaped portions 4*b* are arranged at each end of the crossing 4*a* in a shape of a cross, and this slot shape is obtained by deforming a cross-shaped slot formed by making two long linear slots cross perpendicular to one another. Hence, two radio waves crossing perpendicular to one another and vibrating can be radiated. That is to say, the antenna element 1 serves as perpendicular two slot antennas.

Feeding to the slot 4 is performed by the first and second feeder lines 5, 6, which are located in the diagonal line of the dielectric substrate 2 and passes through the crossing 4*a*. These feeder lines 5, 6 can be realized with a simple construction formed in a linear form.

Since these feeder lines 5, 6 are located on the backside of the conductive plate portion separating the fan-shaped portions 4*b*, there is little influence provided to the radiated wave by the feeder lines 5, 6.

Another embodiment will now be described.

Figure 4:
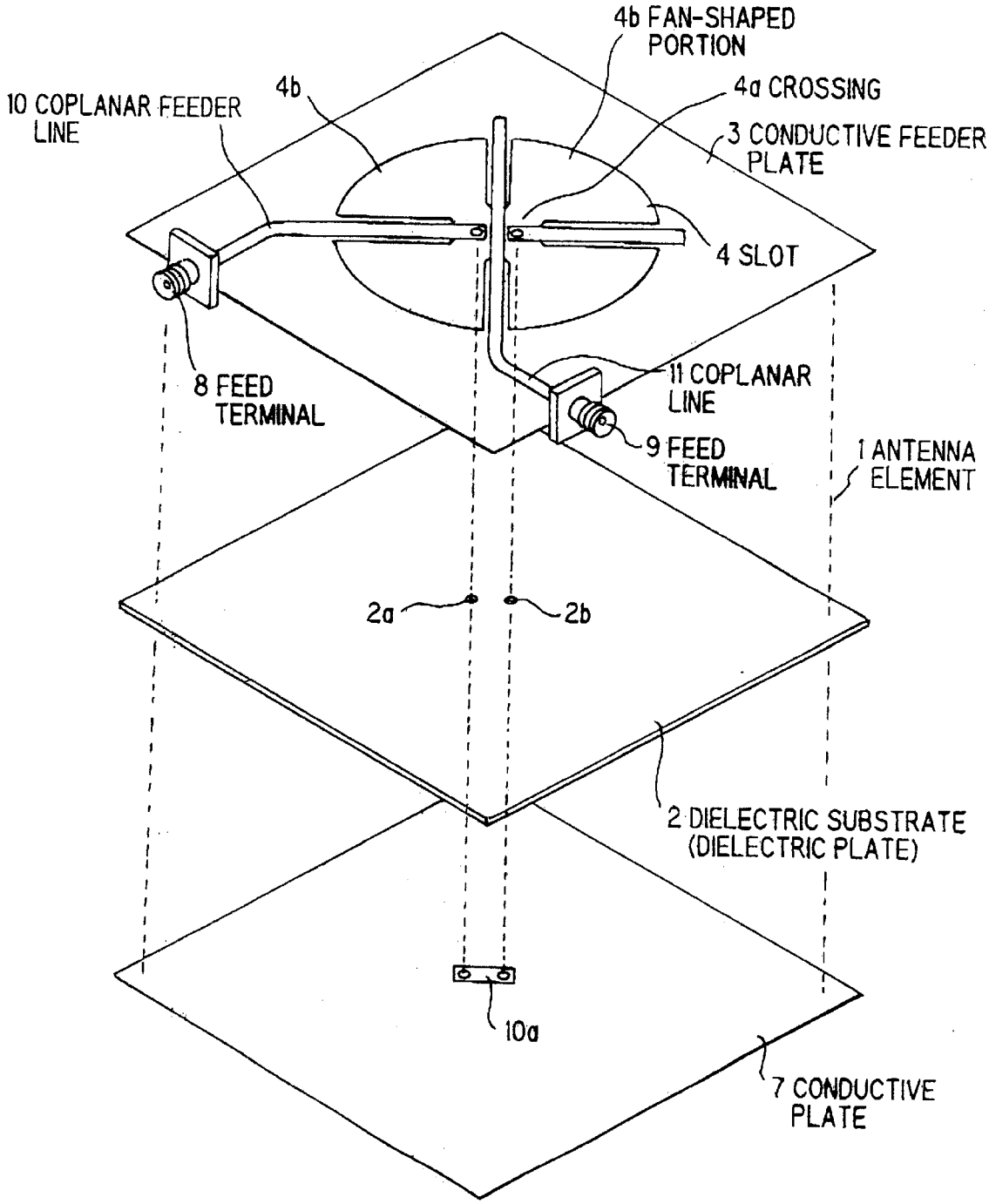
FIG. 4 is a broken view showing an antenna apparatus in another preferred embodiment of the present invention.

The feeder lines 5, 6 are not limited to the one shown in FIG. 3, in which the conductive foils 3, 7 on the whole face except of the portion of the feeder lines are removed by etching, and may be formed by a coplanar line where the feeder line portions are isolated from the conductive plates 3, 7 by a thin groove. By using the antenna element 1 shown in FIG. 1 having a slot 4 formed on the conductive plate 3 overlapped on the front face of the dielectric substrate 2, coplanar lines 10, 11 are arranged along the conductive plate portions separating the fan-shaped portions 4*b*, as shown in FIG. 4, so that respective coplanar lines 10, 11 pass through the crossing 4*s*. The coplanar line 10 is divided into coplanar lines 10*a*, 10*b* so as not to come in contact with the coplanar line 11 at the crossing 4*a*, and these coplanar lines 10*a*, 10*b* are connected to the through holes 2*a*, 2*b*, to thereby form an integral coplanar line 10 via a jumper 10*c* formed on the back face of the dielectric substrate 2. As a result, an antenna apparatus similar to that shown in FIG. 2 is realized.

With the antenna apparatus having the structures shown in FIG. 3 and FIG. 4, the antenna element 1 radiates radio waves symmetrically in the frontal direction and in the backward direction (most part of the conductive plate 7 is removed in the production process). If it is desired to obtain a property of radiating radio wave only in the frontal direction, a reflecting plate may be arranged on the backside of the dielectric substrate 2.

Figure 5:
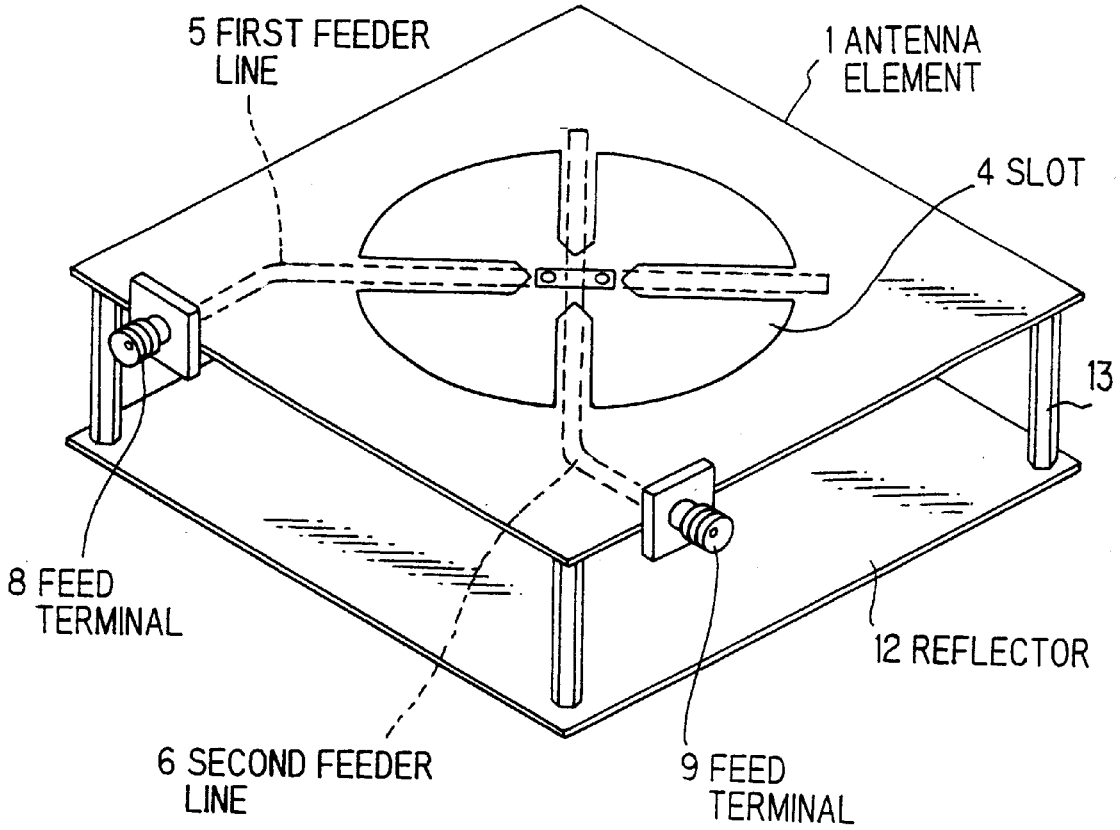
FIG. 5 is a perspective view showing an antenna apparatus in another preferred embodiment of the present invention.

In the antenna apparatus shown in FIG. 5, a reflecting plate 12 is installed at a position separated with a predetermined space from the back face of the dielectric substrate 2, on the backside of the above-described antenna element 1. This reflecting plate 12 can work as a reflecting plate by forming a conductive plate in substantially the same shape as that of the dielectric substrate 2 and attaching it to the antenna element 1 via supports 13 so as to face the antenna element 1.

With this antenna apparatus, since the reflecting plate 12 reflects the radio wave radiated in the backward direction from the antenna element 1, radiation characteristics only in the frontal direction can be obtained, and radio wave can be radiated efficiently in the frontal direction.

Figure 6:
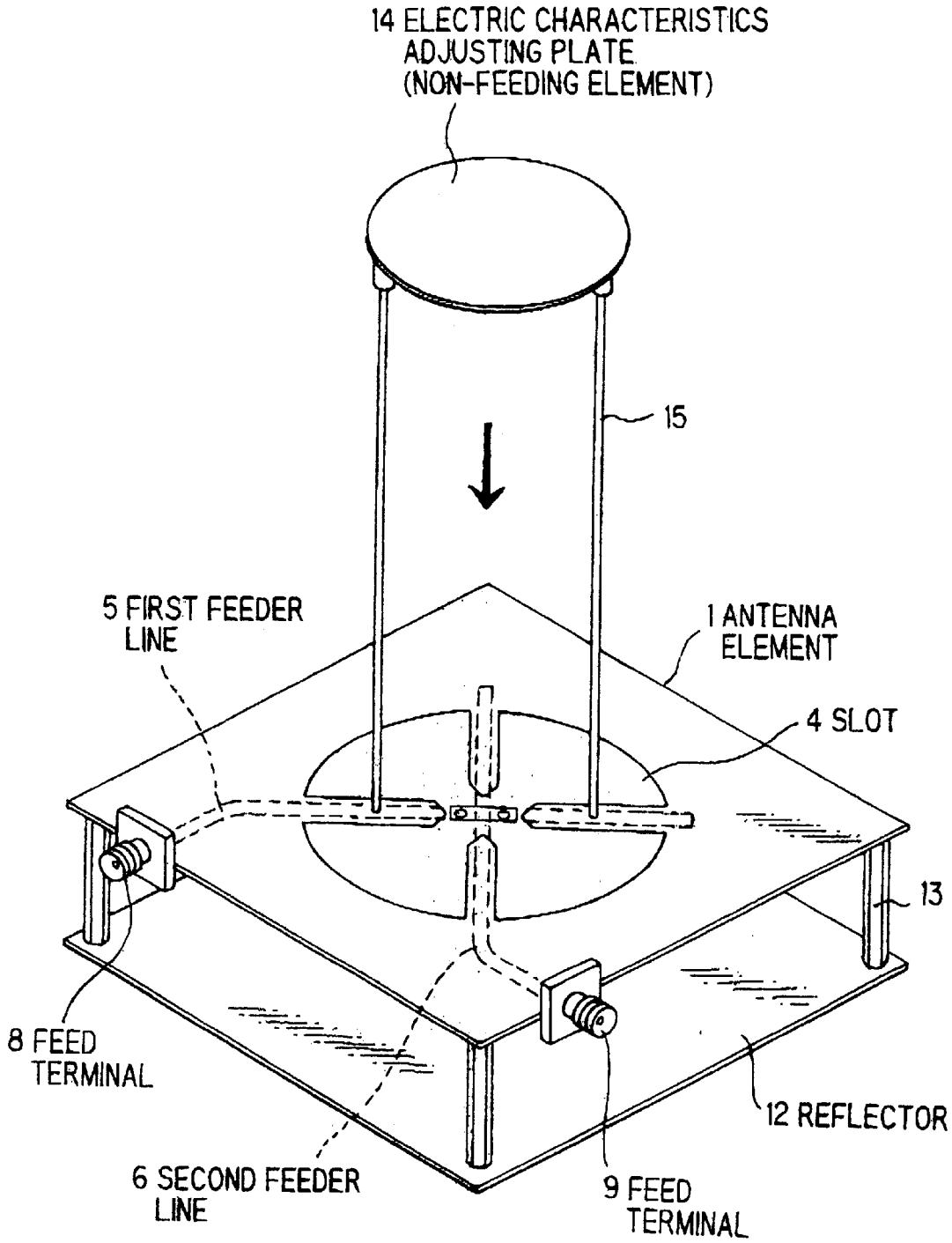
FIG. 6 is a perspective view showing an antenna apparatus in another preferred embodiment of the present invention.

In order to enlarge the band of the radio wave radiated from this antenna apparatus, an electric characteristics adjusting plate may be arranged on the front side of the antenna element 1. In the antenna apparatus shown in FIG. 6, an electric characteristics adjusting plate 14 is installed at a position separated with a predetermined space from the front face of the conductive plate 3, on the front side of the above-described antenna element 1. This electric characteristics adjusting plate 14 can alleviate the frequency characteristics of the antenna element 1 by forming a conductive plate in an optional shape smaller than the antenna element 1, for example in a circular shape, and attaching it to the antenna element 1 via supports 15 so as to face the slot 4.

With this antenna apparatus, the radio wave from the antenna element 1 is radiated with directivity in the frontal direction. However, since the electric characteristics adjusting plate 14 is arranged on the front side of the antenna element 1, not only the resonance by means of the antenna element 1 but also resonance by means of the electric characteristics adjusting plate 14 can be obtained, and hence radio wave can be radiated efficiently over the broadband.

Figure 7:
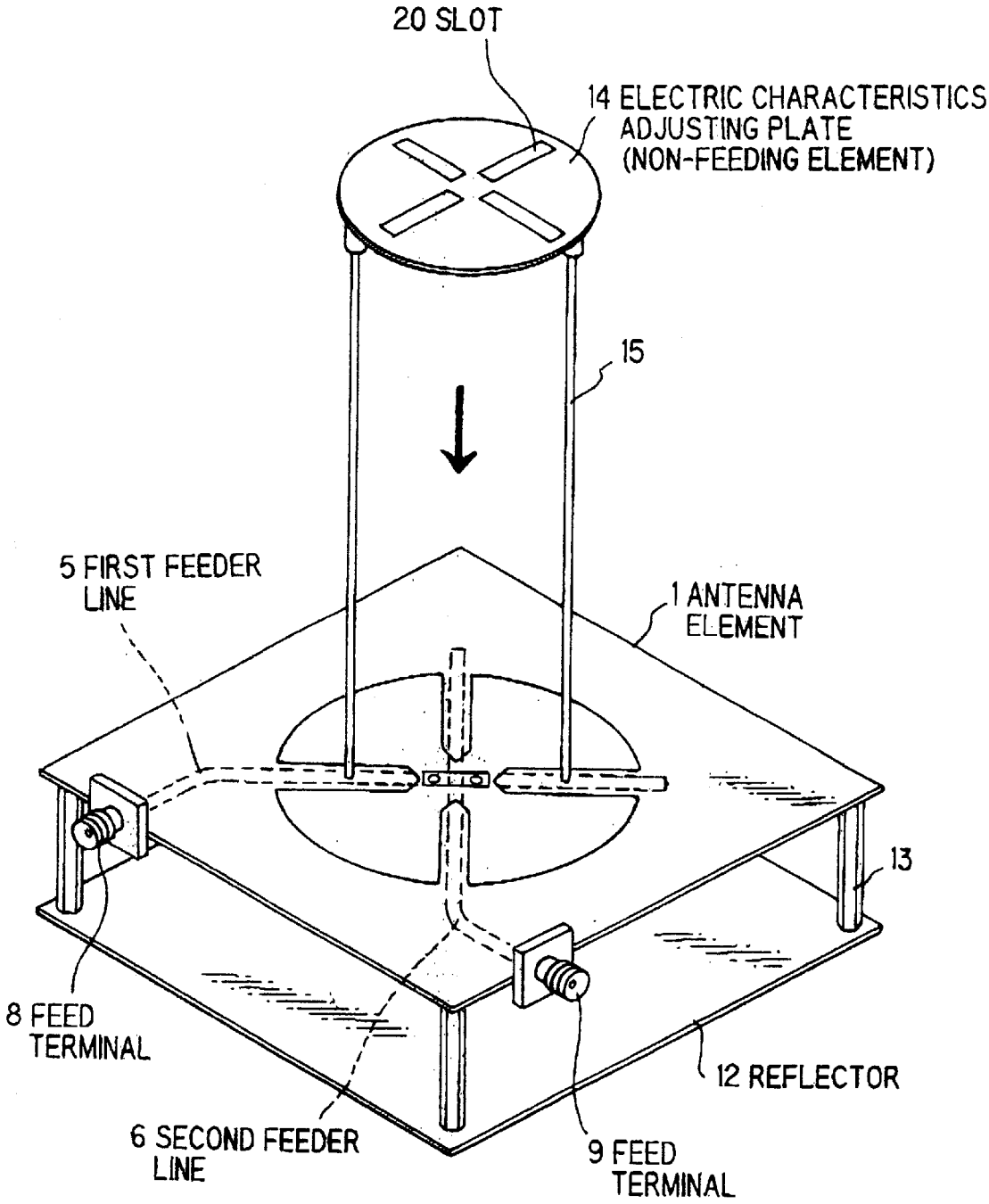
FIG. 7 is a perspective view showing an antenna apparatus in another preferred embodiment of the present invention.

In the antenna apparatus shown in FIG. 7, a slot 20 is formed on the electric characteristics adjusting plate 14. The slot 20 comprises four linear slots located in the extended direction or in the orthogonal direction to each other, and these four slots are arranged in parallel to each linear portion 4*c*, 4*d* of the slot 4.

With this antenna apparatus, influence with respect to each other can be can be suppressed between the two perpendicular slot antennas realized by the antenna element 1.

Arranging a plurality of antenna elements in series in the perpendicular direction in order to enhance the transmission ability constitutes an antenna apparatus in a ground station in the mobile phone system. The present invention is applicable to this antenna apparatus having these pluralities of antenna elements.

Figure 8:
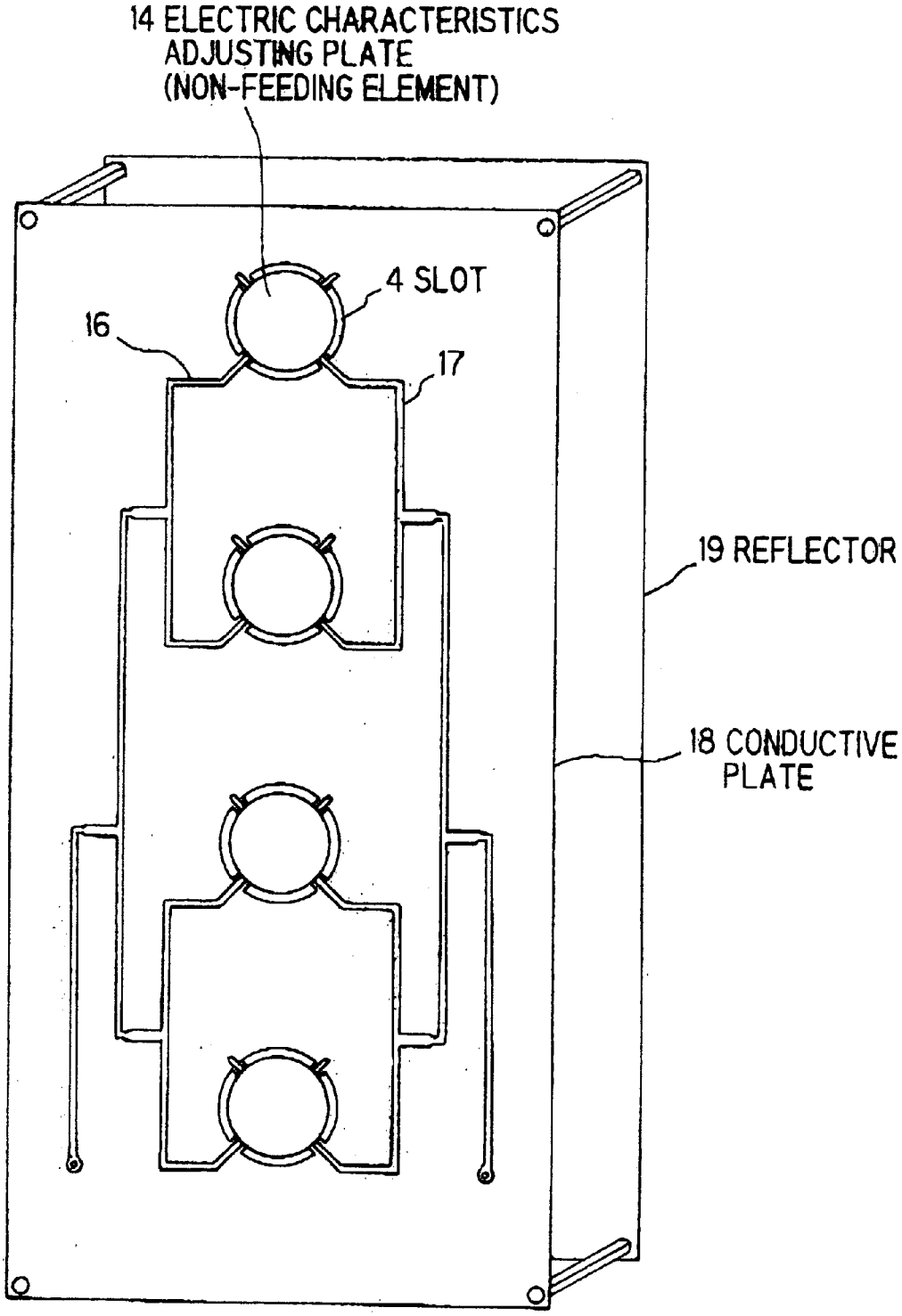
FIG. 8 is a perspective view showing an antenna apparatus in another preferred embodiment of the present invention.

Arranging a plurality of above-described slots 4 in the longitudinal direction, on a conductive plate 18 overlapped on an oblong dielectric substrate having a length for the plurality of antenna elements forms the antenna apparatus shown in FIG. 8. Each slot 4 constitutes an antenna element 1, and power is fed to each antenna element 1 in parallel from microstriplines 16, 17, to thereby constitute a composite antenna element. Etching the conductive plate 18 forms the microstriplines 16, 17. On the backside of this composite antenna element, there is installed a reflecting plate 19 having the same shape as that of the dielectric substrate 2. On the front side of each slot 4, an electric characteristics adjusting plate 14 is respectively installed.

If such a composite antenna element is used in a posture longer in the longitudinal direction, an antenna apparatus having a structure in which a plurality of antenna elements are arranged in series in the perpendicular direction can be realized.

Figure 9:
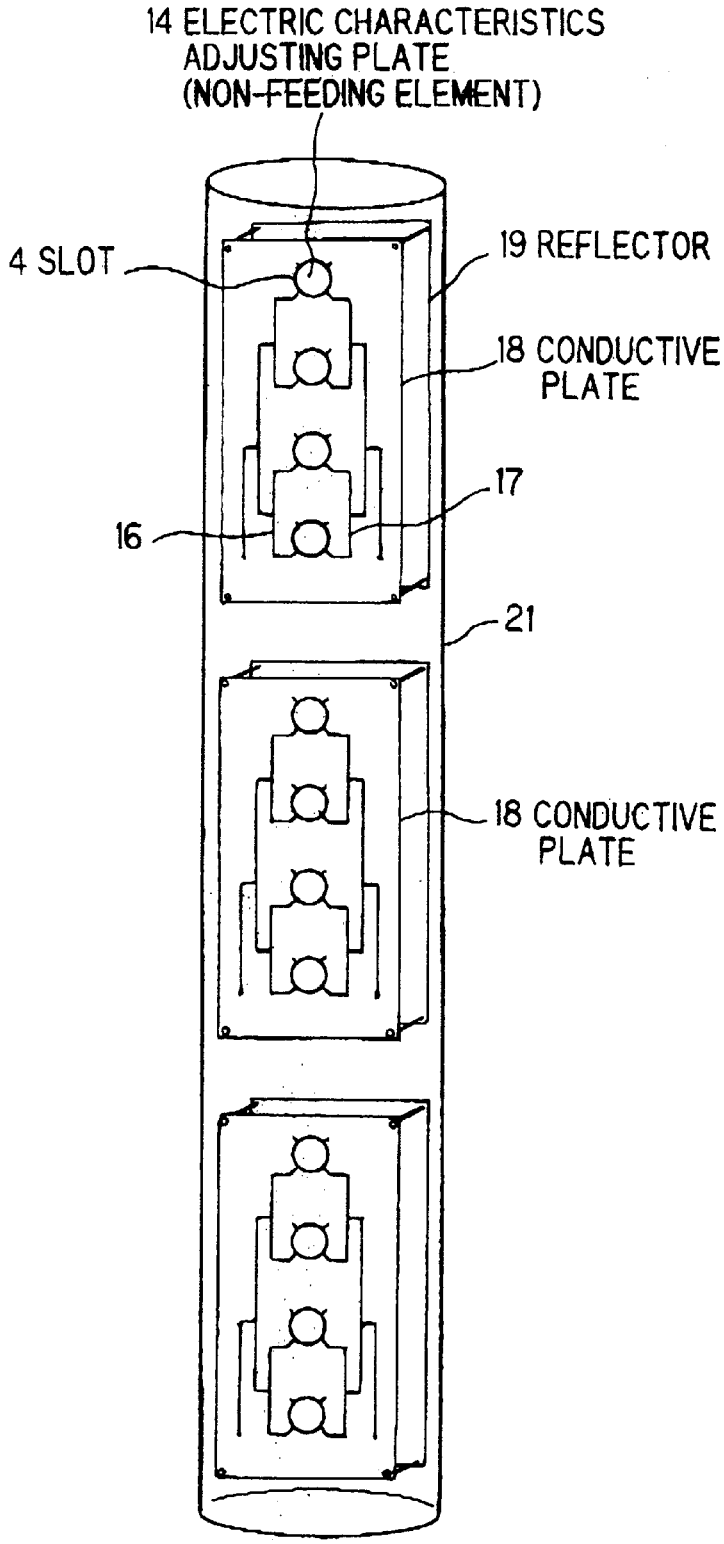
FIG. 9 is a perspective view showing an antenna apparatus in another preferred embodiment of the present invention.

Also as shown in FIG. 9, by arranging a plurality of composite antenna elements in series in the perpendicular direction in a posture longer in the longitudinal direction, and covering these with a cylindrical plastic cover 21, multiple-string longitudinal antenna apparatus can be formed easily.

In embodiments shown in figures from FIG. 1 to FIG. 9, by providing the linear portions 4*c*, 4*d* of the slot 4 horizontally or vertically, an antenna apparatus having the same function as the antenna apparatus having two long linear slots crossed each other horizontally and or vertically is realized. Hereinafter, there will be described an embodiment in which the slots 4 are formed in a state rotated by 45°.

Figure 10:
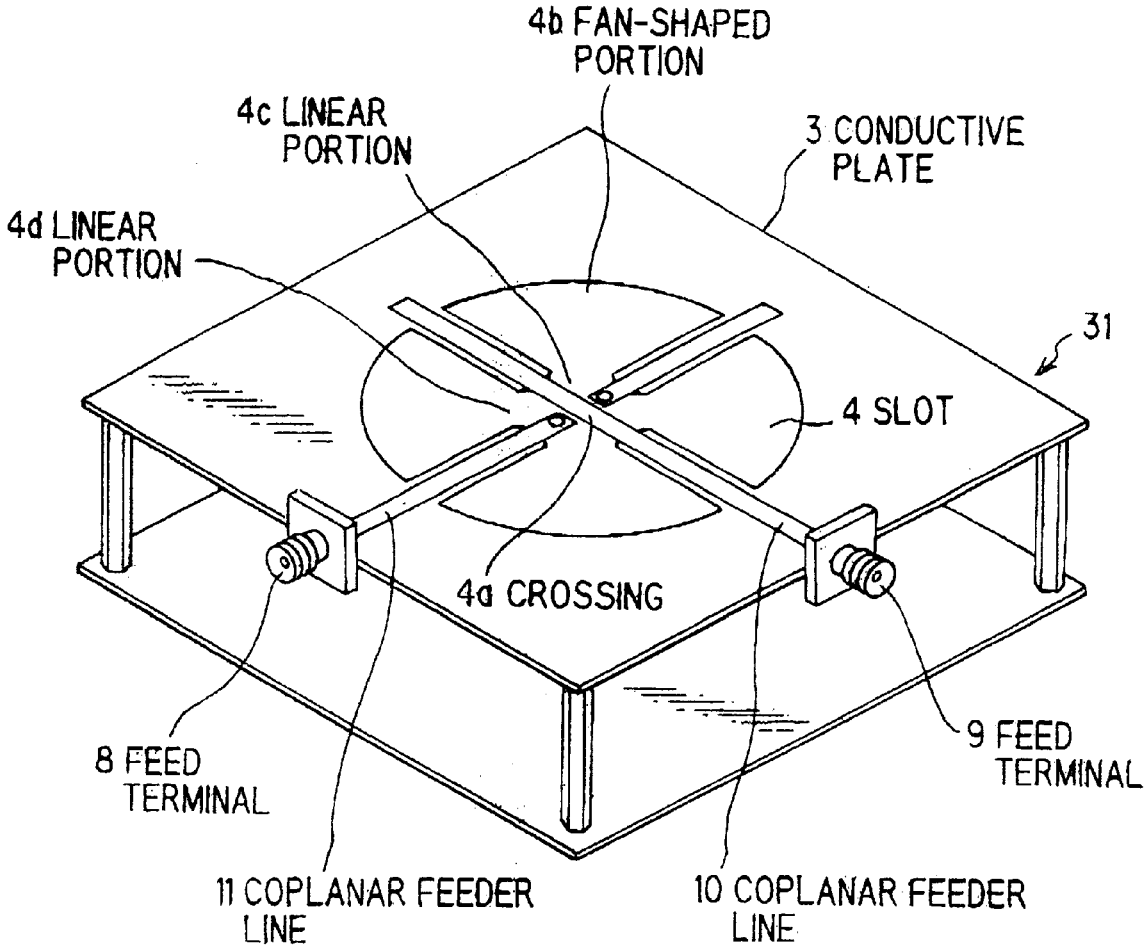
FIG. 10 is a perspective view showing an antenna apparatus in another preferred embodiment of the present invention.

An antenna element 31 of the antenna apparatus shown in FIG. 10 is constructed by forming a slot 4 having a crossing 4*a* in a shape of a cross, at which two linear portions 4*c*, 4*d* having the same length and extending straight with a predetermined width cross at right angles, at the center in the longitudinal direction to each other, and having fan-shaped portions 4*b* at opposite ends of each linear portion, expanding gradually than the width of the linear portions 4*c*, 4*d* and fanning out, on a conductive plate 3 overlapped on a dielectric substrate (not shown).

The dielectric substrate is a square, and the conductive plate 3 is also a square having the same size. The slot 4 is provided so that the linear portions 4*c*, 4*d* have an inclination of ±45° with respect to each side of the dielectric substrate 2, and the crossing 4*a* is located at the center of the dielectric substrate 2. The linear portions 4*c*, 4*d* are located in the diagonal of the dielectric substrate 2. The fan-shaped portions 4*b* are connected to the linear portions 4*c*, 4*d*. The side of the fan-shaped portions 4*b* has an inclination of ±45° with respect to the linear portion 4*c*, thereby the fan-shaped portions 4*b* has an opening angle of 90° and the outer periphery is a circular arc. Moreover, there are provided a linear first feeder line (a coplanar line 10, herein) forming an angle of ±45° with respect to one linear portion 4*c* and a second feeder line (a coplanar line 11) forming an angle of −45° with respect to the linear portion 4*c*. These first and second feeder lines 10, 11 are introduced straightway from the feeder terminals 8, 9 provided on two sides of the dielectric substrate 2.

The antenna apparatus shown in FIG. 10 has substantially the same operation as that of the antenna apparatus shown in FIG. 5.

Figure 11:
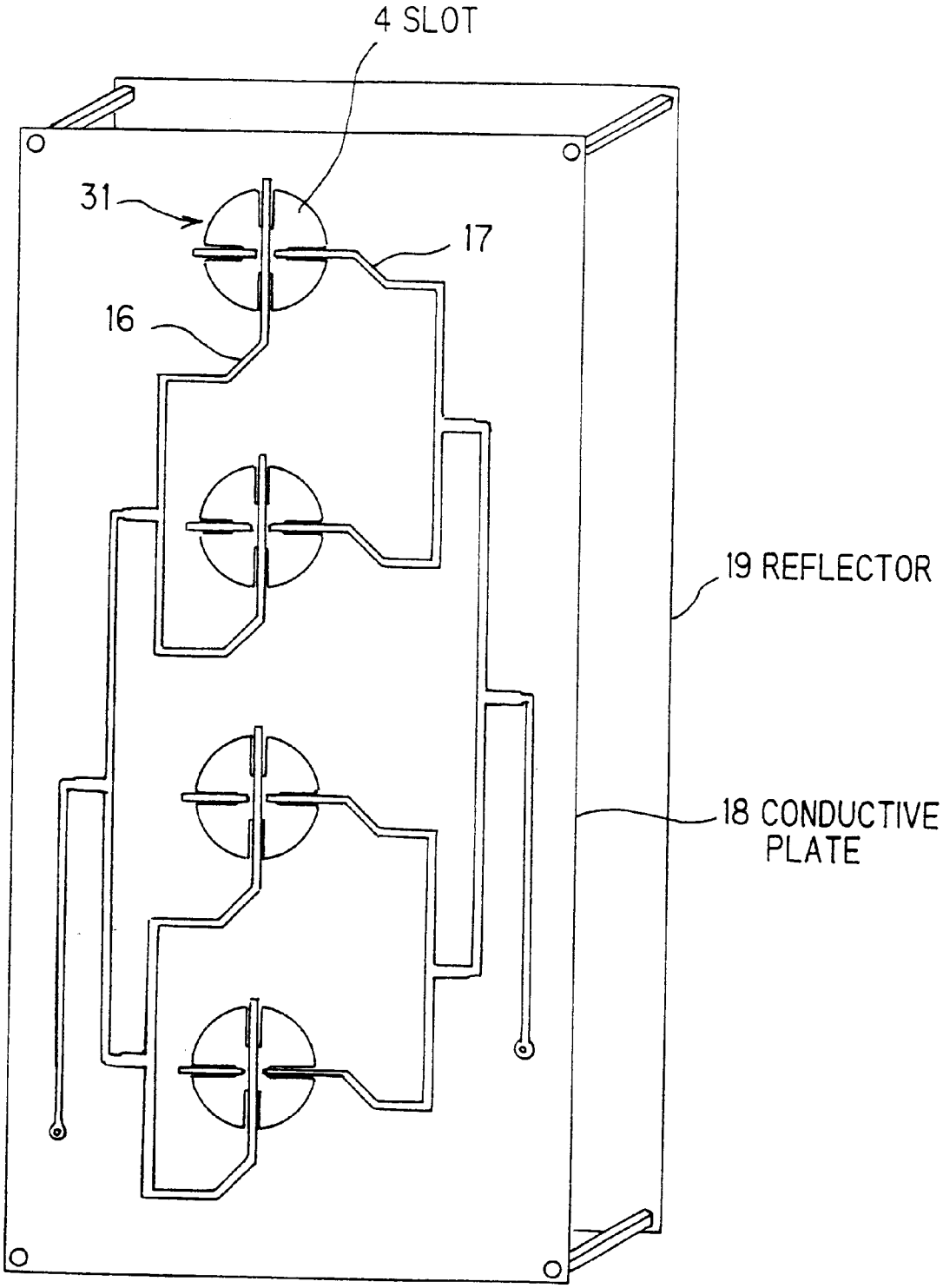
FIG. 11 is a perspective view showing an antenna apparatus in another preferred embodiment of the present invention.

A plurality of antenna elements 31 may be arranged on one conductive plate. As shown in FIG. 11, a plurality of slots 4 are formed in series in the longitudinal direction, on a conductive plate 18 overlapped on an oblong dielectric substrate having a length for the plurality of antenna elements. Power is fed to each antenna element 31 in parallel from microstriplines 16, 17, to thereby constitute a composite antenna element. On the backside of this composite antenna element 18, there is installed a reflecting plate 19 having the same shape as that of the dielectric substrate 2. On the front side of each slot 4, an electric characteristics adjusting plate 14 is respectively installed.

If such a composite antenna element is used in a posture longer in the longitudinal direction, an antenna apparatus having a structure in which a plurality of antenna elements are arranged in series in the perpendicular direction can be realized.

Figure 12:
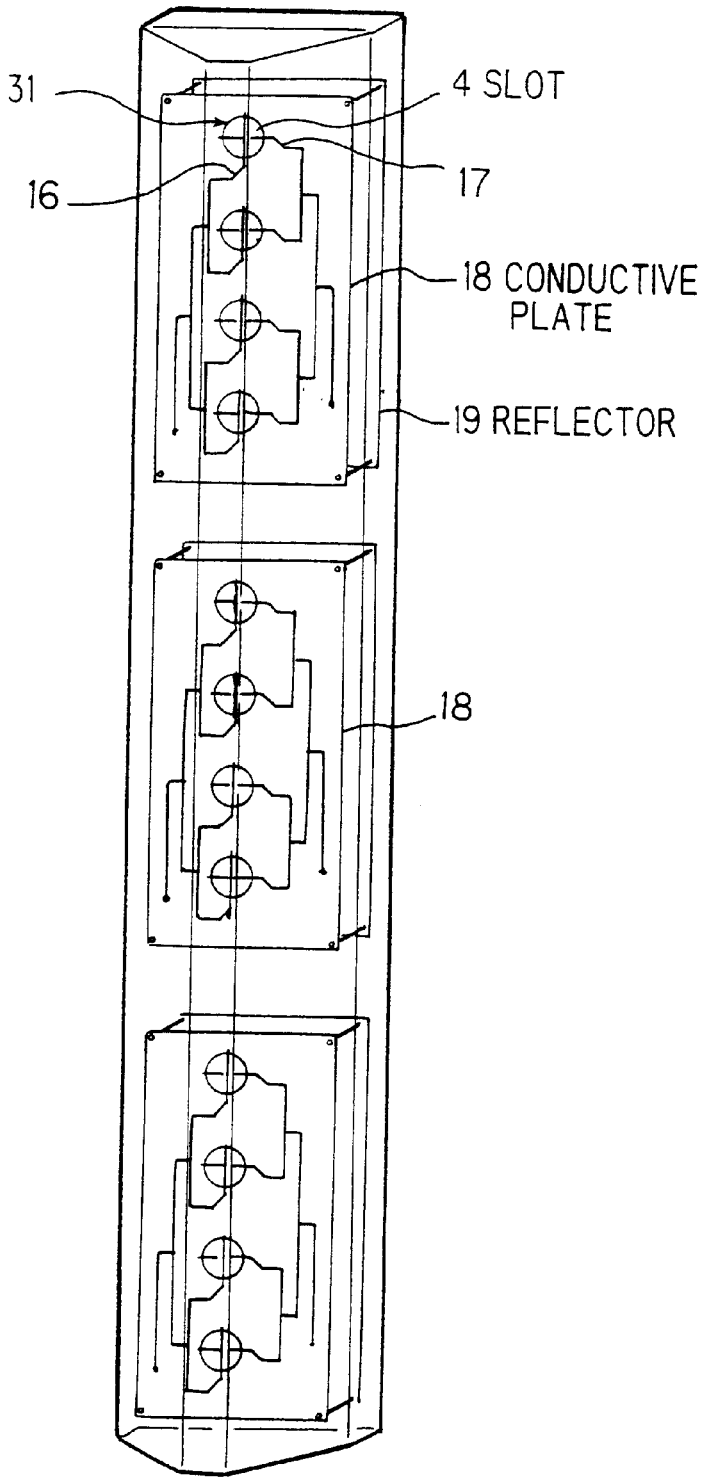
FIG. 12 is a perspective view showing an antenna apparatus in another preferred embodiment of the present invention.

Also as shown in FIG. 12, by arranging a plurality of composite antenna elements in series in the perpendicular direction in a posture longer in the longitudinal direction, and covering these with a cylindrical plastic cover 21, multiple-string longitudinal antenna apparatus can be formed easily.

Figure 13:
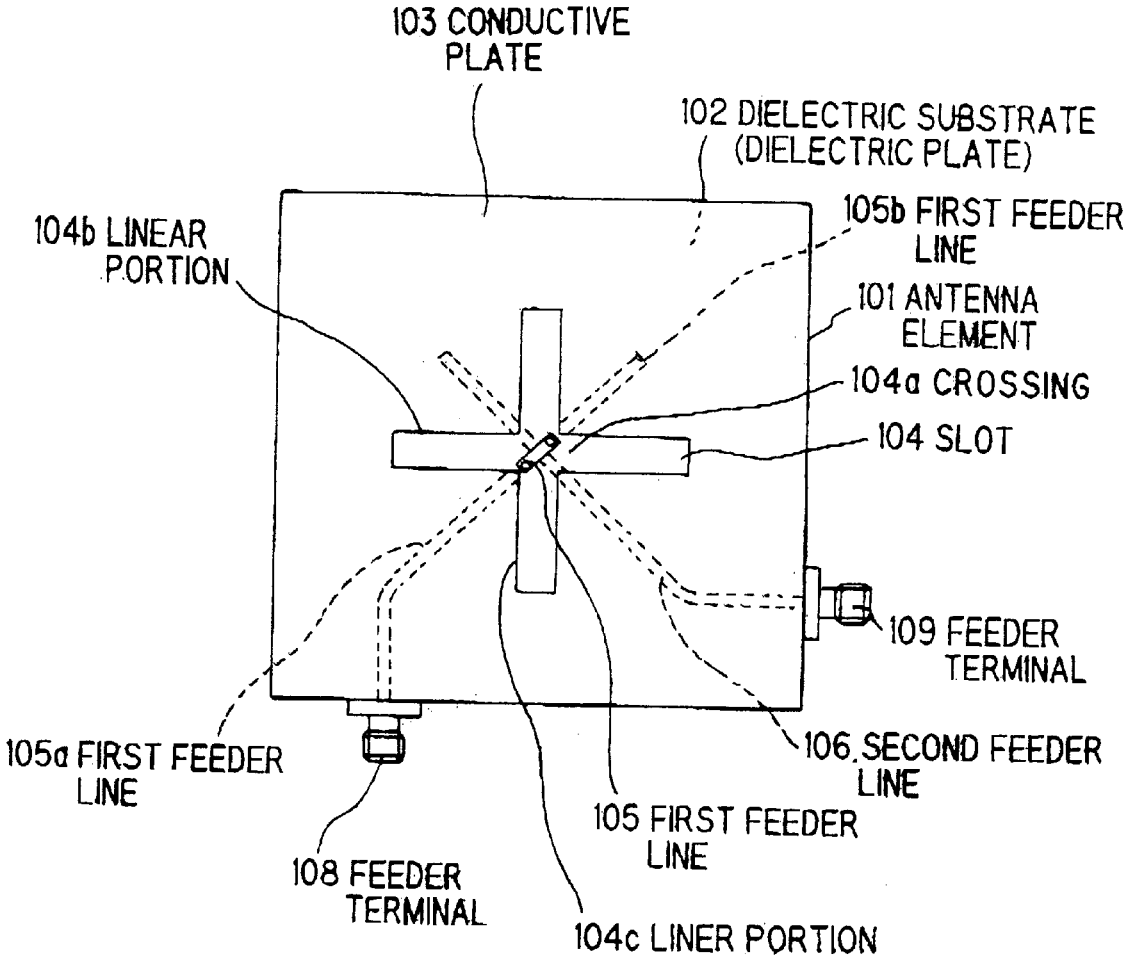
FIG. 13 is a plan view showing an antenna apparatus in another preferred embodiment of the present invention.

As shown in FIG. 13, The antenna apparatus of the present invention is such that a pair of antenna elements is constituted by forming a slot having such a shape that two linear portions 104*b*, 104*c* having the same length and extending straight with a predetermined width cross at right angles, at the center in the longitudinal direction of each other, on a conductive plate 103 overlapped on one face (referred to as "front face") of a dielectric substrate 102, and a first feeder line 105 forming an angle of +45° with respect to one linear portion and a second feeder line 106 forming an angle of −45° with respect to this linear portion are provided along the dielectric substrate 102 so as to pass through a crossing 104*a* of the two linear portions 104*b* and 104*c*, respectively, and in the vicinity of the crossing 104*a*, one feeder line 105 is arranged on one face of the dielectric substrate 102 and the other feeder line 106 is arranged on the opposite face of the dielectric substrate 102.

The dielectric substrate 102 is a square, and the conductive plate 103 is also a square having the same size. The slot 104 is provided so that the linear portions 104*c*, 104*d* are in parallel or at right angles with respect to each side of the dielectric substrate 102, and the crossing 104*a* is located at the center of the dielectric substrate 102.

The first and second feeder lines 105, 106 are introduced at right angles to each side from feeder terminals 108, 109 provided on two sides of the dielectric substrate 102, and bent at the diagonal line of the dielectric substrate 102, so as to pass through the crossing 104*a*. For the feeder terminals 108, 109, for example, a coaxial connector is used, so that the internal conductor of the coaxial connector is connected to the feeder lines 105, 106 and the outside conductor is connected to the conductive plate 103.

Figure 14:
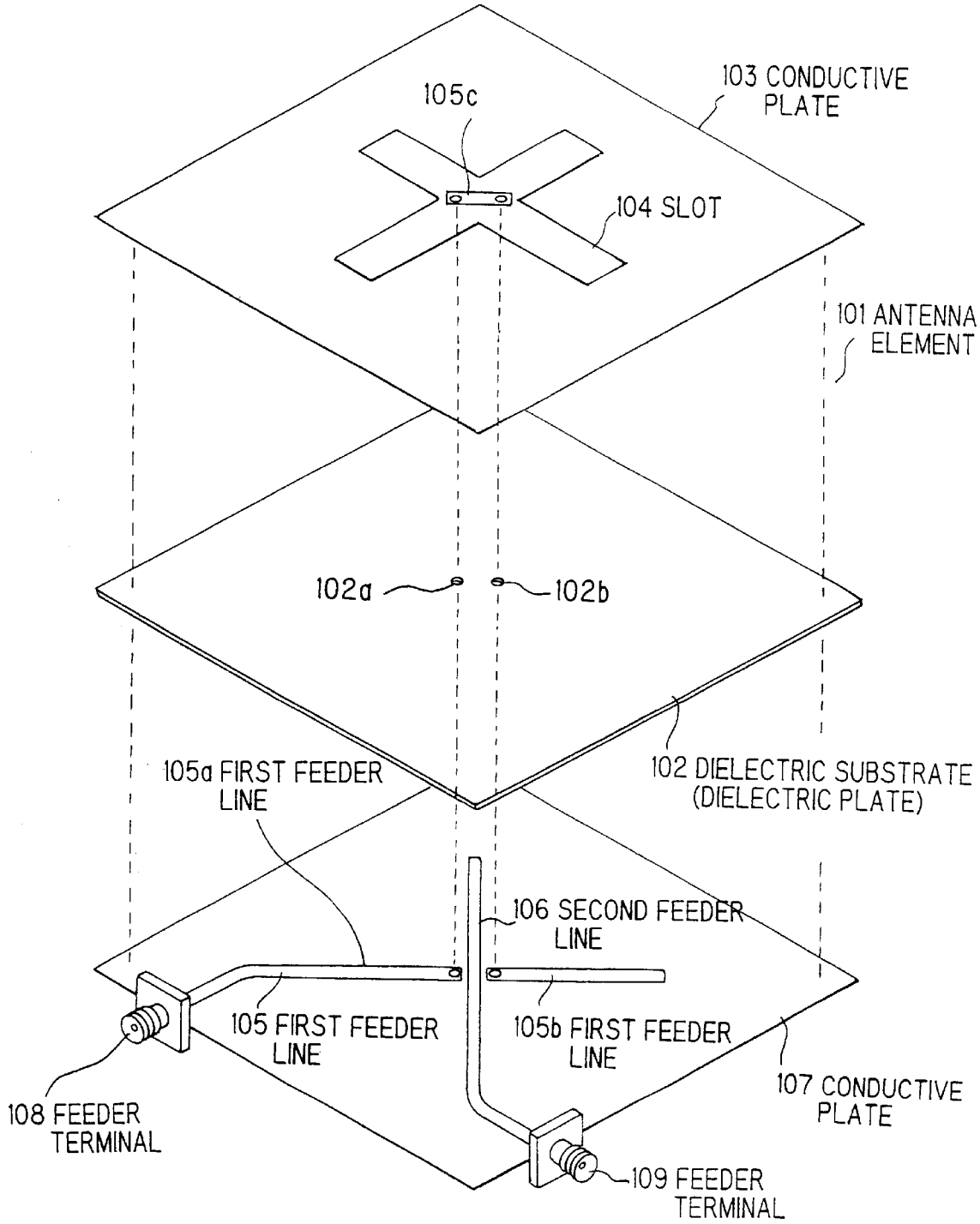
FIG. 14 is a broken view showing the antenna apparatus in FIG. 13.

As shown in FIG. 14, the first feeder line 105 and the second feeder line 106 are arranged along the dielectric substrate 102 on the face (referred to as "back face") opposite to the face of the dielectric substrate 102 where the conductive plate 103 is overlapped. The first feeder line 105 is divided into a feeder line 105*a* and a feeder line 105*b* at the position of the crossing 104*a*, and the second feeder line 106 passes between these divided feeder lines 105*a*, 105*b*. On the dielectric substrate 102, there are provided through holes 102*a*, 102*b* having a conductivity, at the position where the feeder lines 105*a*, 105*b* are divided, and on the conductive plate 103, there is provided a conductive jumper 105*c* spanning over the through holes 102*a*, 102*b*. Actually, the conductive plate 103, the dielectric substrate 102 and the feeder lines 105*a*, 105*b*, 106 closely overlap on each other, and hence the feeder line 105*a*, the through hole 102*a*, the jumper 105*c*, the through hole 102*b* and the feeder line 105*b* are conducted to thereby form the integral first feeder line 105.

The specific manufacturing method of this antenna apparatus is such that a printed circuit board in which conductive plates (conductive foils) 103, 107 comprising copper, aluminum or the like are formed on the opposite sides of the dielectric substrate 102 is used, the conductive plate 103 on the front face of this printed circuit board is etched to thereby form the slot 104 and the jumper 105*c*, and the conductive plate 107 on the back face thereof is also etched to thereby form the divided feeder lines 105*a*, 105*b* of the first feeder line 105 and the second feeder line 106. Then, the through holes 102*a*, 102*b* are connected and the feeder terminals 108, 109 are attached.

Next, the operation of this antenna apparatus will be described.

In this antenna apparatus, making two long linear slots cross at right angles, and hence two radio waves crossing perpendicular to one another forms the cross-like shape of the slot 104 and vibrating can be radiated. That is to say, the antenna element 101 serves as perpendicular two slot antennas.

Feeding to the slot 104 is performed by the first and second feeder lines 105, 106, which are located in the diagonal line of the dielectric substrate 102 and passes through the crossing 104*a*. These feeder lines 105, 106 can be realized with a simple construction formed in a linear form.

Another embodiment will now be described.

The feeder lines 105, 106 are not limited to the one shown in FIG. 14, in which the conductive foils 103, 107 on the whole face except of the portion of the feeder lines are removed by etching, and may be formed by a coplanar line where the feeder line portions are isolated from the conductive plates 103, 107 by a thin groove.

Figure 15:
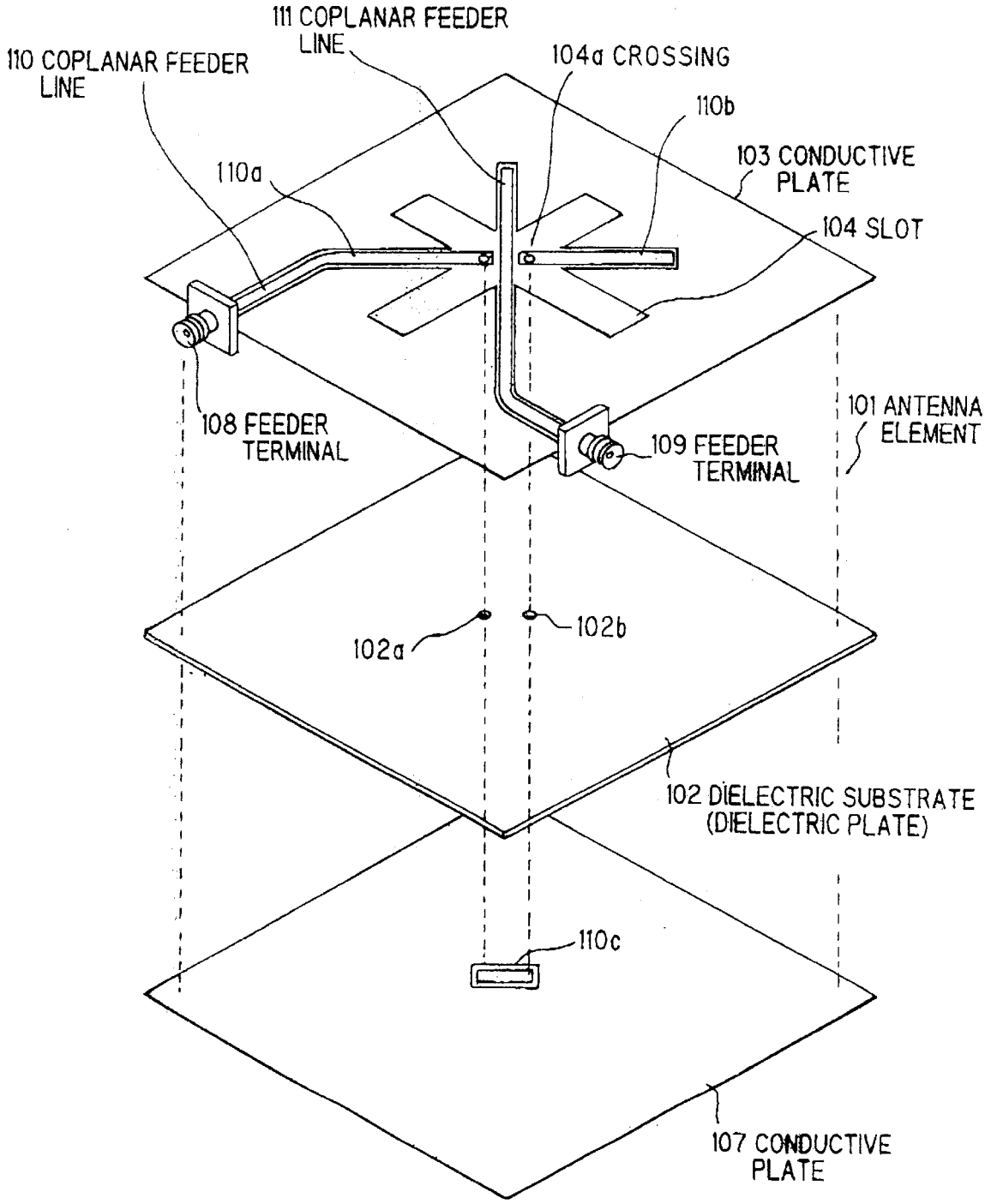
FIG. 15 is a broken view showing an antenna apparatus in another preferred embodiment of the present invention.

As shown in FIG. 15, by forming the cross-like slot 104 on the conductive plate 103 overlapped on the front face of the dielectric substrate 102 and arranging coplanar lines 110, 11 in the diagonal of the dielectric substrate 102, respective coplanar lines 110 and 111 can pass through the crossing 104*a*. The coplanar line 110 is divided into coplanar lines 110*a*, 110*b* so as not to come in contact with the coplanar line 11 at the crossing 104*a*, and these coplanar lines 110*a*, 110*b* are connected to the through holes 102*a*, 102*b*, to thereby form an integral coplanar line 110 via a jumper 110*c* formed on the back face of the dielectric substrate 102. As a result, an antenna apparatus similar to that shown in FIG. 14 is realized.

With the antenna apparatus having the structure shown in FIG. 14, the antenna element 1 radiates radio waves symmetrically in the frontal direction and in the backward direction (most part of the conductive plate 107 is removed in the production process, and hence does not interfere radiation). If it is desired to obtain a property of radiating radio wave only in the frontal direction, a reflecting plate may be arranged on the backside of the dielectric substrate 102.

Figure 16:
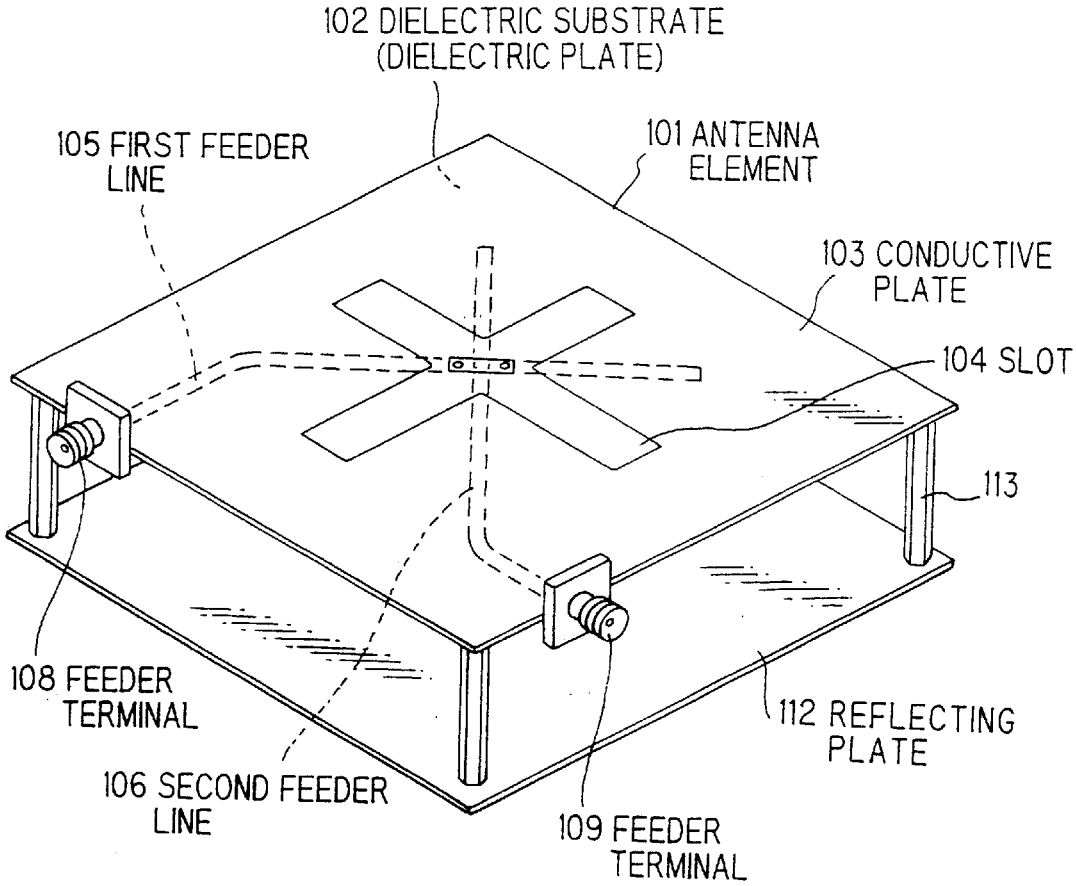
FIG. 16 is a perspective view showing an antenna apparatus in another preferred embodiment of the present invention.

In the antenna apparatus shown in FIG. 16, a reflecting plate 112 is installed at a position separated with a predetermined space from the back face of the dielectric substrate 102, on the backside of the above-described antenna element 101. This reflecting plate 112 can work as a reflecting plate by forming a conductive plate in substantially the same shape as that of the dielectric substrate 102 and attaching it to the antenna element 101 via supports 113 so as to face the antenna element 101.

With this antenna apparatus, since the reflecting plate 112 reflects radio wave radiated in the backward direction from the antenna element 1, radiation characteristics only in the frontal direction can be obtained, and radio wave can be radiated efficiently in the frontal direction.

In order to enlarge the band of the radio wave radiated from this antenna apparatus, an electric characteristics adjusting plate may be arranged on the front side of the antenna element 101. In the antenna apparatus shown in FIG. 18, an electric characteristics adjusting plate 114 is installed at a position separated with a predetermined space from the front face of the conductive plate 103, on the front side of the above-described antenna element 101. This electric characteristics adjusting plate 114 can alleviate the frequency characteristics of the antenna element 1 by forming a conductive plate in an optional shape smaller than the antenna element 101, for example in a circular shape, and attaching it to the antenna element 101 via supports 115 so as to face the slot 104.

With this antenna apparatus, the radio wave from the antenna element 101 is radiated with directivity in the frontal direction. However, since the electric characteristics adjusting plate 114 is arranged on the front side of the antenna element 101, not only the resonance by means of the antenna element 101 but also resonance by means of the electric characteristics adjusting plate 114 can be obtained, and hence radio wave can be radiated efficiently over the broadband.

Arranging a plurality of antenna elements in series in the perpendicular direction in order to enhance the transmission ability constitutes an antenna apparatus in a ground station in the mobile phone system. The present invention is applicable to this antenna apparatus having these pluralities of antenna elements.

Figure 18:
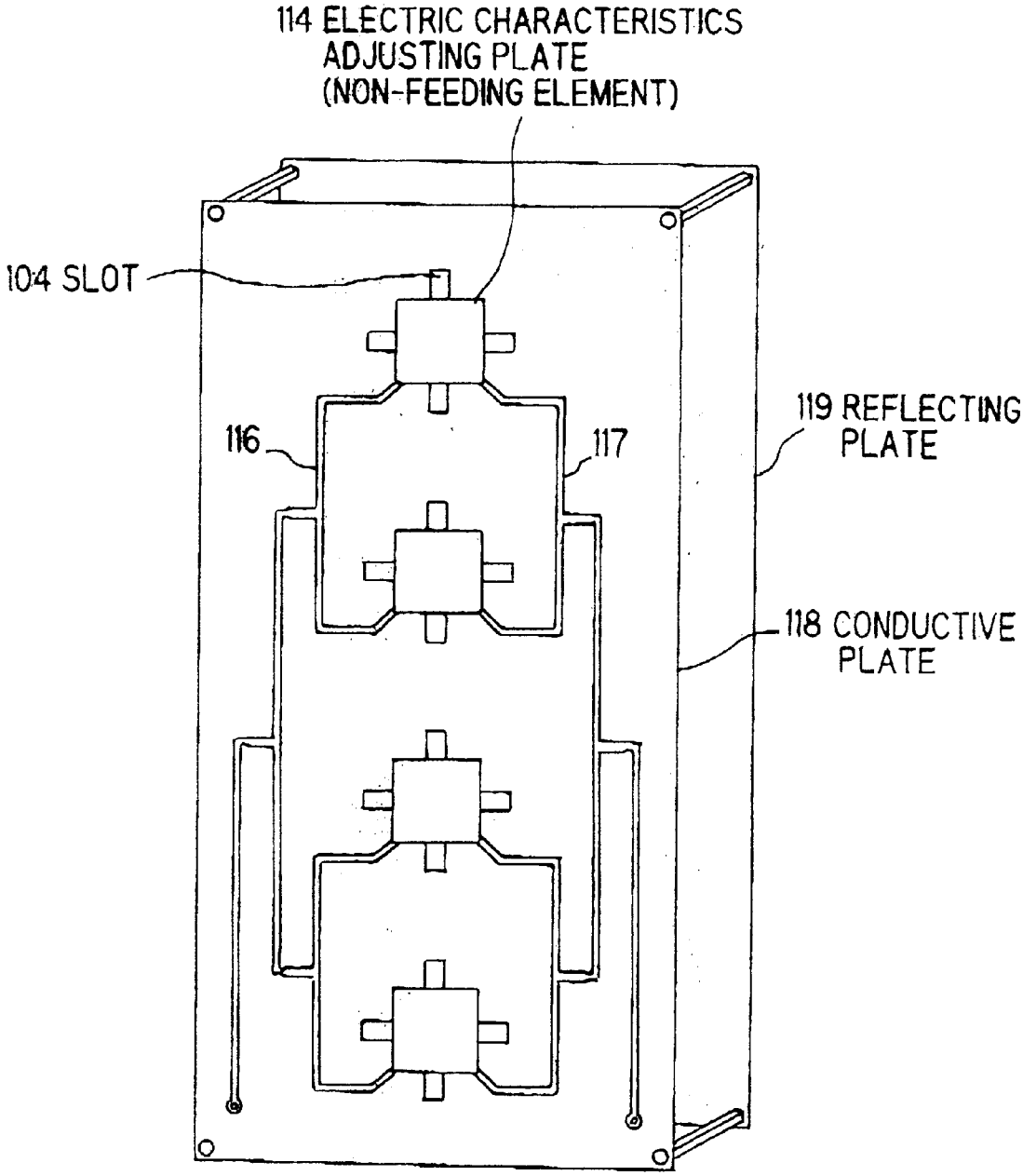
FIG. 18 is a perspective view showing an antenna apparatus in another preferred embodiment of the present invention.

Arranging a plurality of above-described slots 104 in the longitudinal direction, on a conductive plate 118 overlapped on an oblong dielectric substrate having a length for the plurality of antenna elements forms the antenna apparatus shown in FIG. 18. Each slot 104 constitutes an antenna element 101, and power is fed to each antenna element 101 in parallel from microstriplines 116, 117, to thereby constitute a composite antenna element. Etching the conductive plate 118 forms the microstriplines 116, 117. On the backside of this composite antenna element, there is installed a reflecting plate 119 having the same shape as that of the dielectric substrate 102. On the front side of each slot 104, an electric characteristics adjusting plate 114 is respectively installed.

If such a composite antenna element is used in a posture longer in the longitudinal direction, an antenna apparatus having a structure in which a plurality of antenna elements are arranged in series in the perpendicular direction can be realized.

Figure 19:
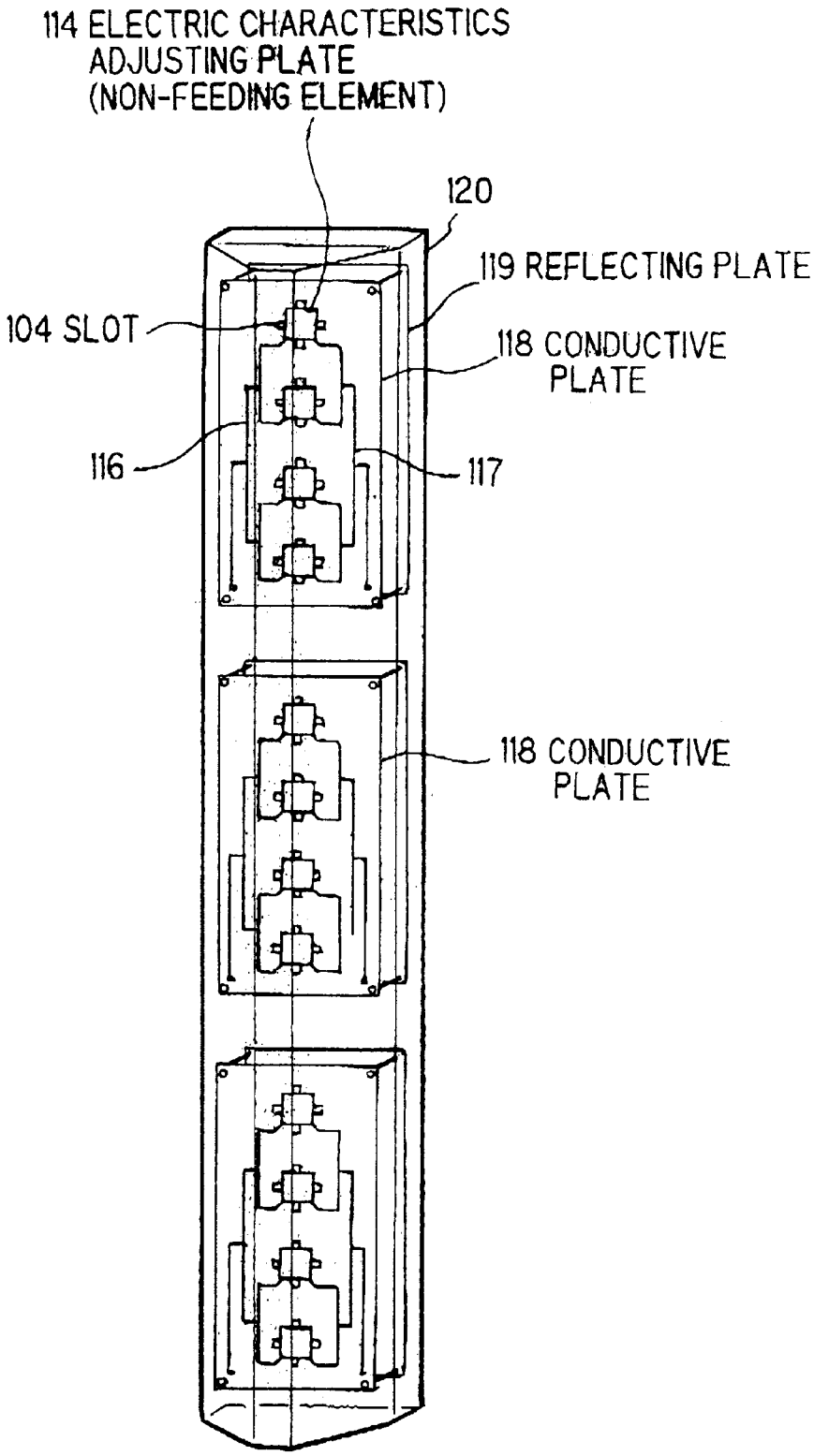
FIG. 19 is a perspective view showing an antenna apparatus in another preferred embodiment of the present invention.
Figure 20:
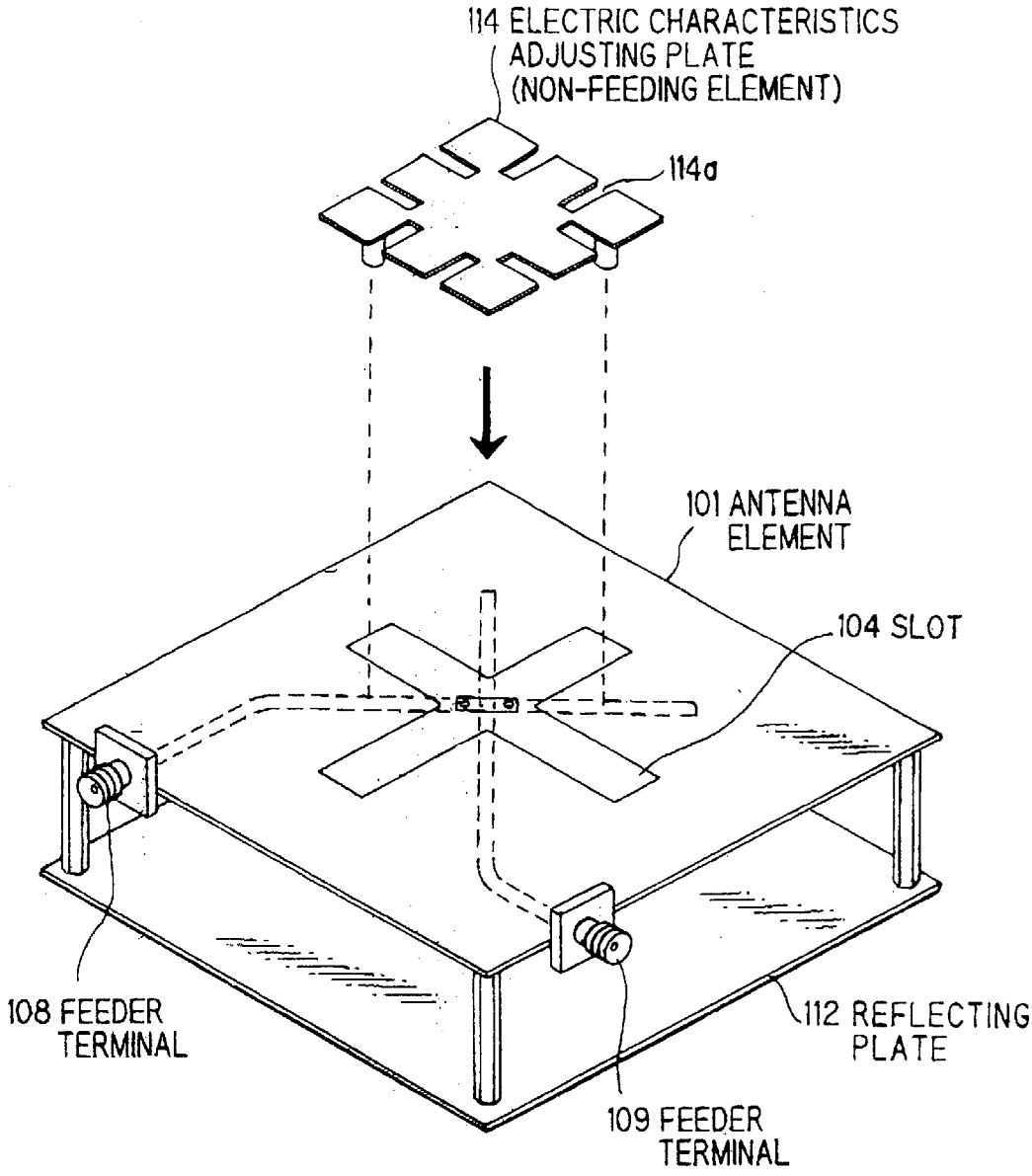
FIG. 20 is a broken perspective view showing an antenna apparatus in another preferred embodiment of the present invention.

Also as shown in FIG. 19, by arranging a plurality of composite antenna elements in series in the perpendicular direction in a posture longer in the longitudinal direction, and covering these with a cylindrical plastic cover 120, multiple-string longitudinal antenna apparatus can be formed easily.

Figure 17:
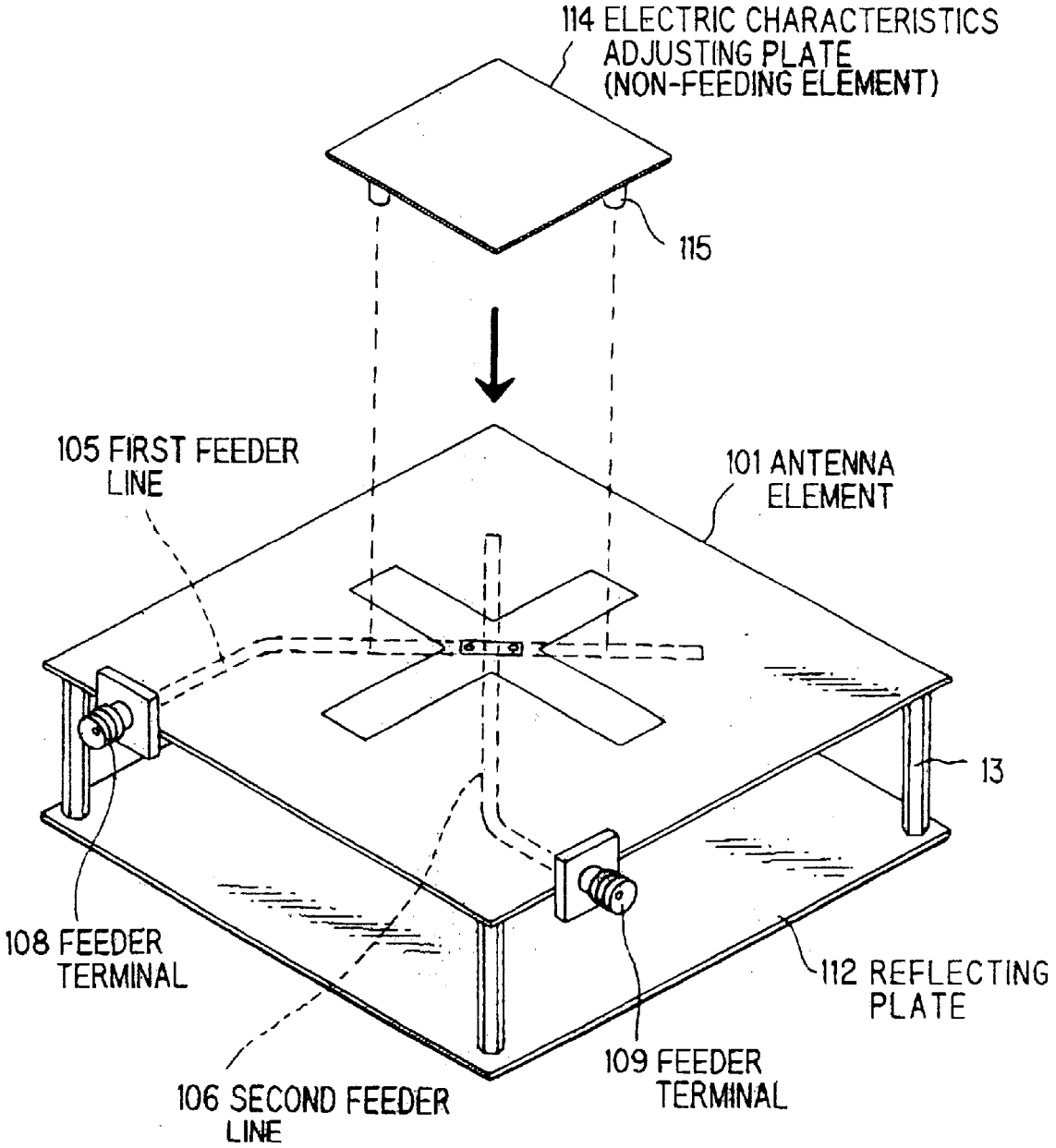
FIG. 17 is a perspective view showing an antenna apparatus in another preferred embodiment of the present invention.

The antenna apparatus shown in FIG. 20 to FIG. 26 are obtained by variously changing the electric characteristics adjusting plate 114 of the antenna apparatus shown in FIG. 17.

In the antenna apparatus shown in FIG. 18, a notch 114*a* is formed in each side of the electric characteristics adjusting plate 114. By forming notches 114*a* in this manner, the frequency characteristics of the antenna apparatus can be changed.

Figure 21:
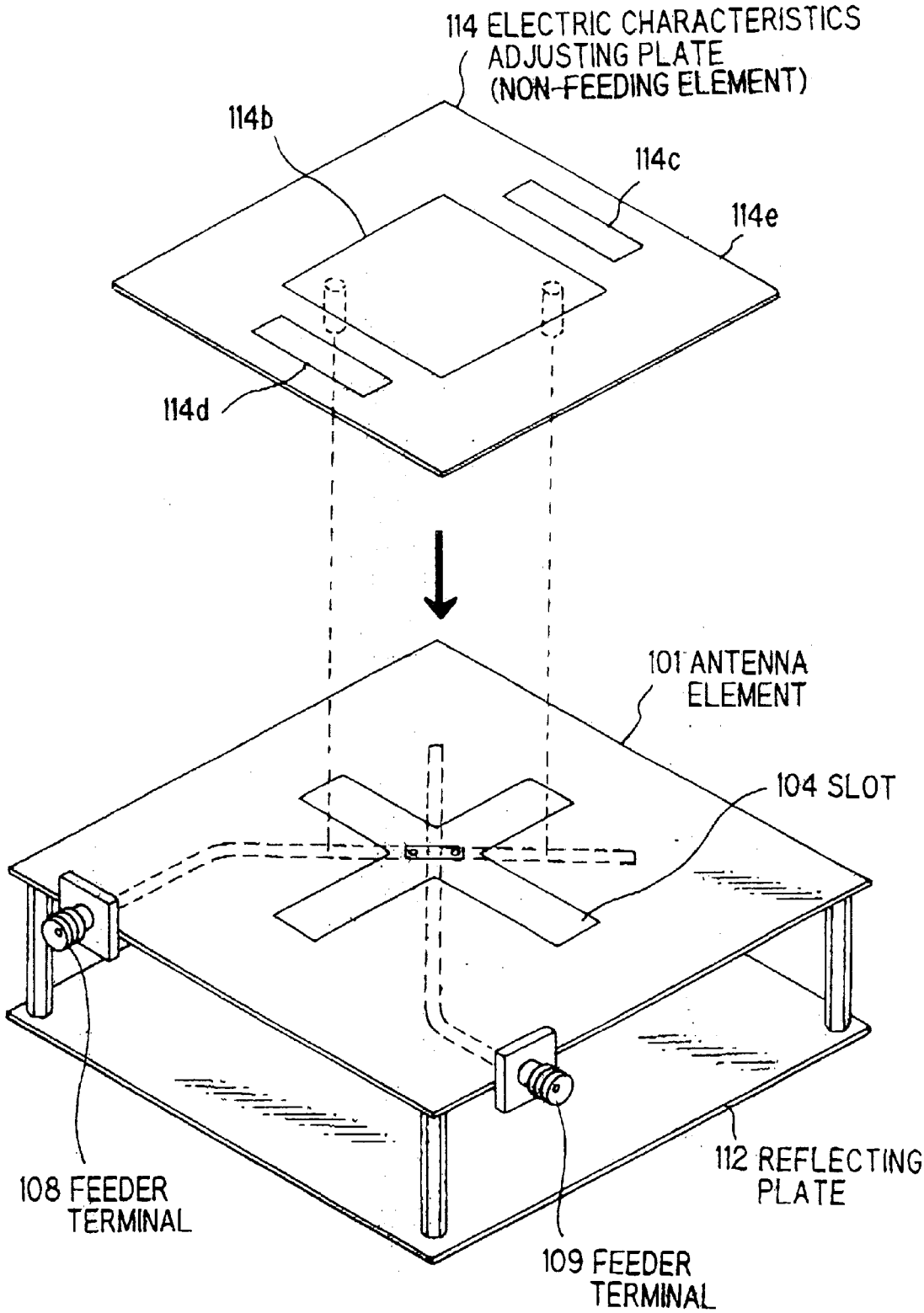
FIG. 21 is a broken perspective view showing an antenna apparatus in another preferred embodiment of the present invention.

In the antenna apparatus shown in FIG. 21, the electric characteristics adjusting plate 114 is constituted of a square main adjusting plate 114*b* located at the center and long and narrow supplementary adjusting plates 114*c*, 114*d* located outside of the opposing two sides of the main adjusting plate 114*b*. In this manner, by forming the electric characteristics adjusting plate 114 by dividing into several parts, the frequency characteristics of the antenna apparatus can be changed. The electric characteristics adjusting plate 114 of this antenna apparatus is formed by etching a conductive plate provided on one face of the dielectric substrate 114*c*. As described above, the electric characteristics adjusting plate 114 is not constituted of the conductive plate alone, but may be constituted by providing a conductor along the dielectric substrate 114*e*.

Figure 22:
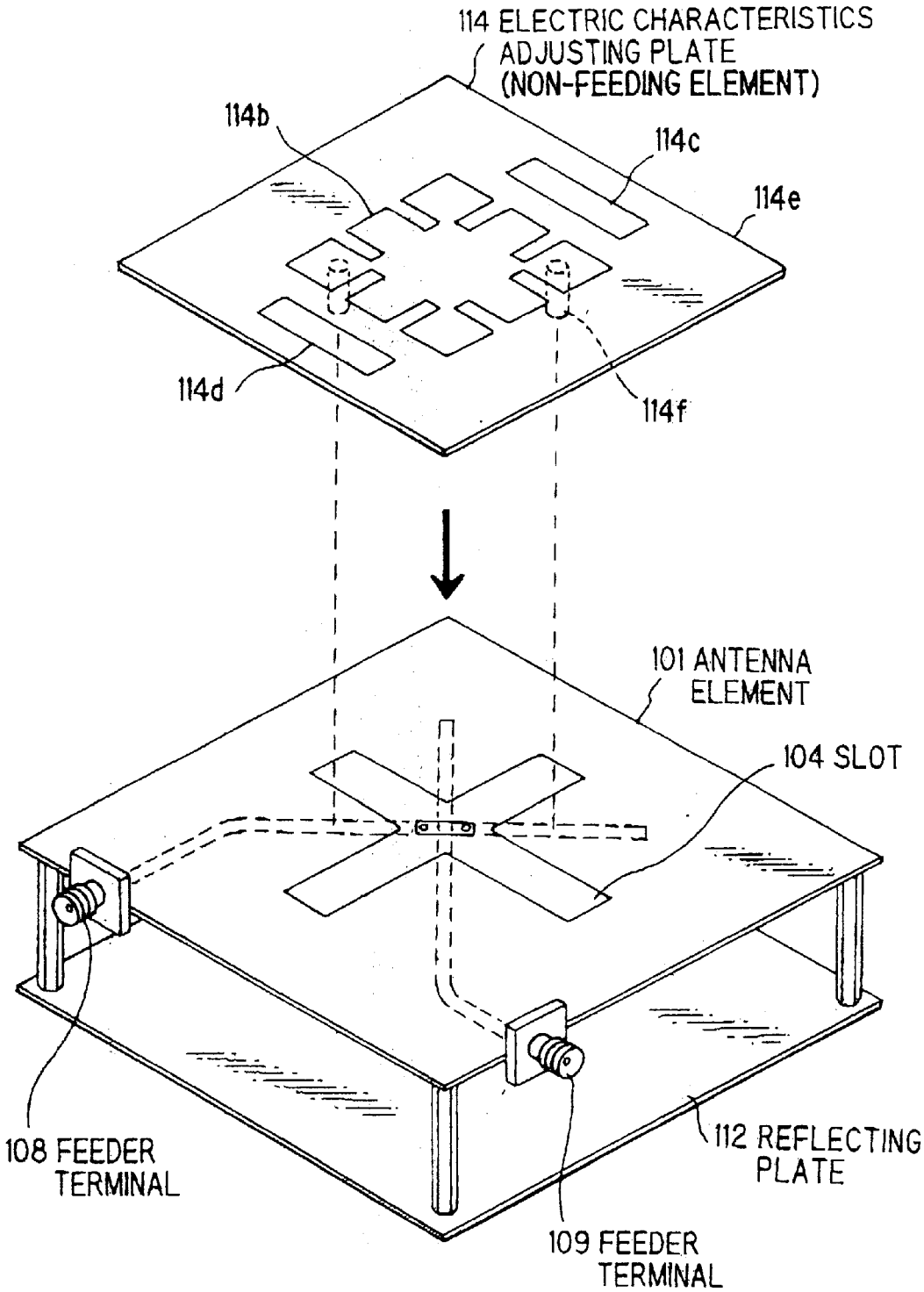
FIG. 22 is a broken perspective view showing an antenna apparatus in another preferred embodiment of the present invention.

In the antenna apparatus shown in FIG. 22, notches 114*f* are formed in each side of the main adjusting plate 114*b* of the antenna apparatus in FIG. 21. In this manner, the frequency characteristics of the antenna apparatus can be changed by means of the main adjusting plate 114*b* having notches 114*f*, and long and narrow supplementary adjusting plates 114*c*, 114*d* located outside thereof.

Figure 23:
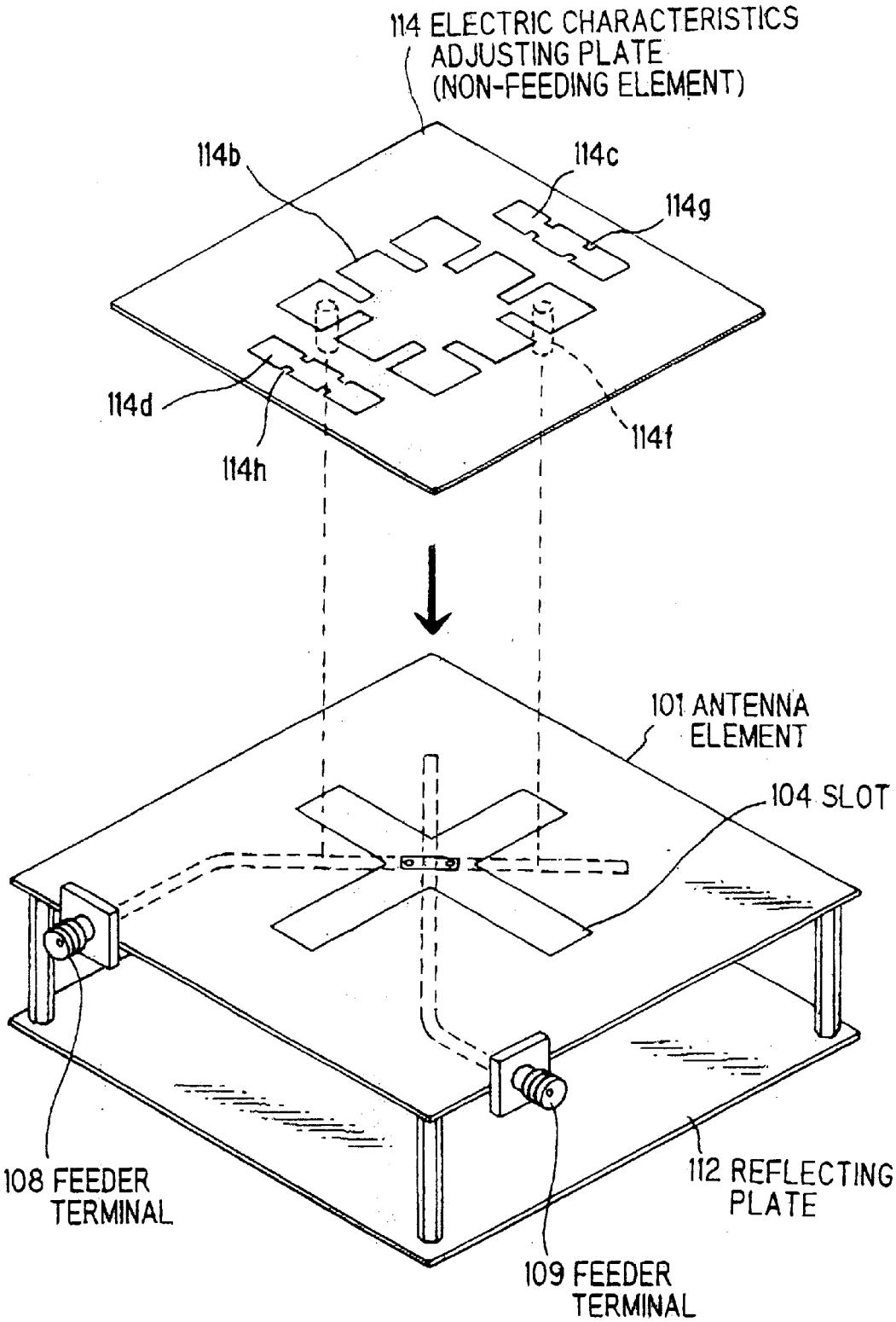
FIG. 23 is a broken perspective view showing an antenna apparatus in another preferred embodiment of the present invention.

In the antenna apparatus shown in FIG. 23, notches 114*g*, 114*h* are formed in each side of the supplementary adjusting plates 114*c*, 114*d* of the antenna apparatus in FIG. 22. In this manner, the frequency characteristics of the antenna apparatus can be changed by forming notches 114*g* and 114*h* in each long side of the supplementary adjusting plates 114*c*, 114*d*.

Figure 24:
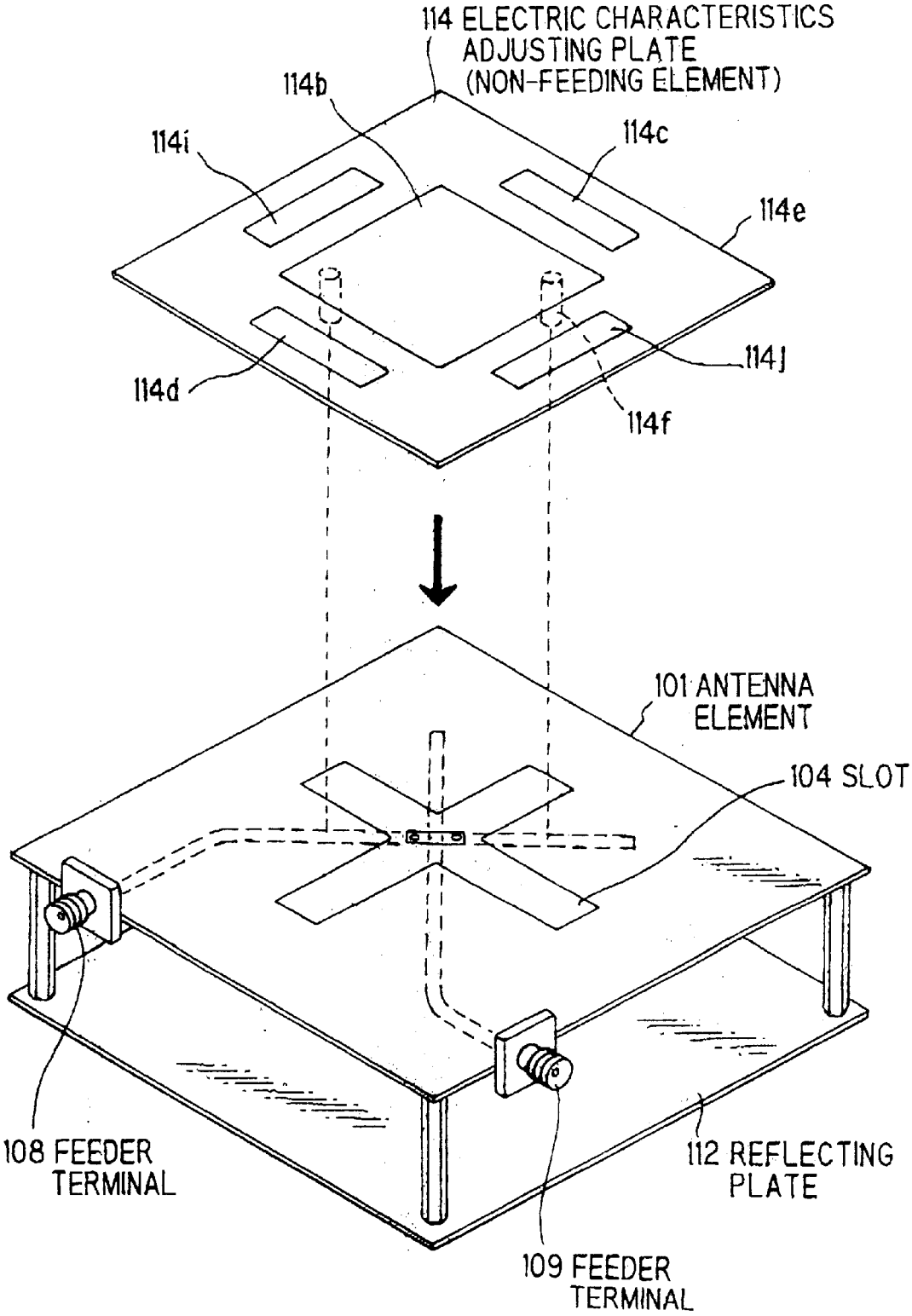
FIG. 24 is a broken perspective view showing an antenna apparatus in another preferred embodiment of the present invention.

In the antenna apparatus shown in FIG. 24, long and narrow supplementary adjusting plates 114*i*, 114*j* are also provided outside of the remaining opposing two sides of the main adjusting plate 114*b* in the antenna apparatus in FIG. 21. In this manner, forming supplementary adjusting plates 114*c*, 114*d*, 114*i* and 114*j* outside of the four sides of the main adjusting plate 114*b* can change, the frequency characteristics of the antenna apparatus.

Figure 25:
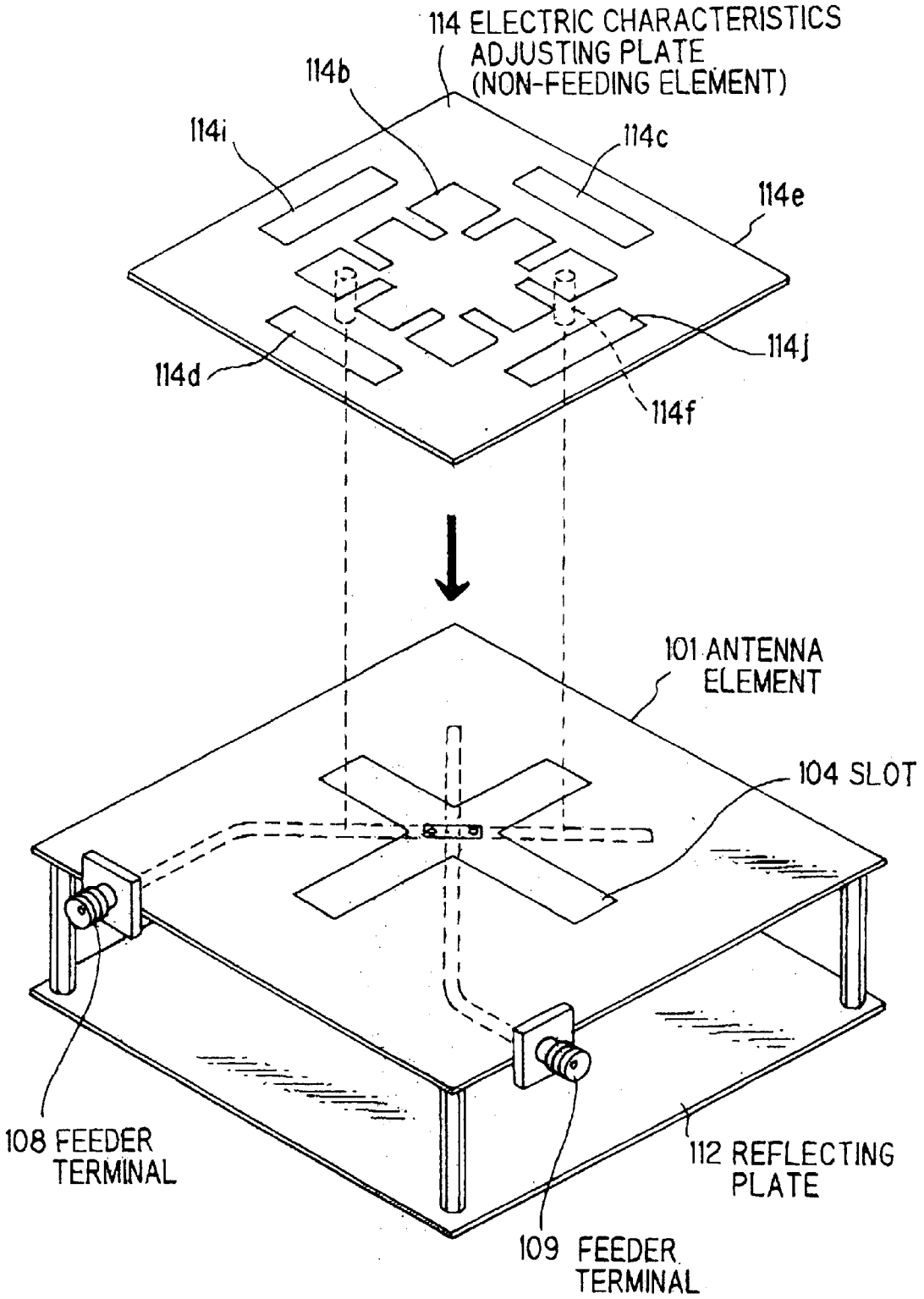
FIG. 25 is a broken perspective view showing an antenna apparatus in another preferred embodiment of the present invention.

In the antenna apparatus shown in FIG. 25, notches 114*f* are formed in each side of the main adjusting plate 114*b* of the antenna apparatus in FIG. 24. In this manner, the frequency characteristics of the antenna apparatus can be changed by means of the main adjusting plate 114*b* having notches 114*f*, and long and narrow supplementary adjusting plates 114*c*, 114*d*, 114*i* and 114*j* located outside thereof.

Figure 26:
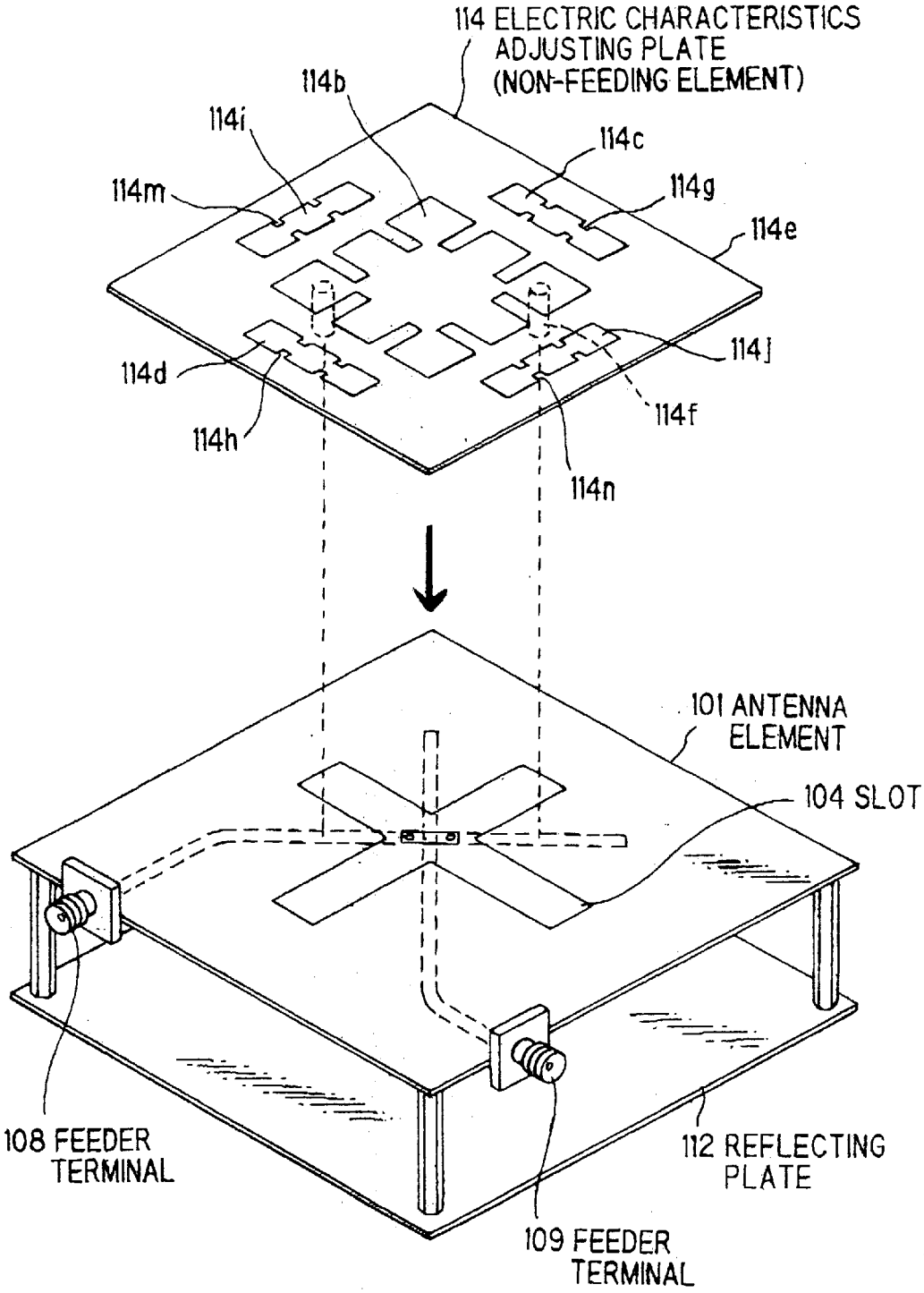
FIG. 26 is a broken perspective view showing an antenna apparatus in another preferred embodiment of the present invention.

In the antenna apparatus shown in FIG. 26, notches 114*g*, 114*h*, 114*m*, 114*n* are formed in each side of the supplementary adjusting plates 114*c*, 114*d*, 114*i*, 114*j* of the antenna apparatus in FIG. 25. In this manner, the frequency characteristics of the antenna apparatus can be changed by forming notches 114*g*, 114*h*, 114*m* and 114*n* in each long side of the supplementary adjusting plates 114*c*, 114*d*, 114*i* and 114*j*.

In the embodiments shown in the above-described figures, the linear portions 104*b*, 104*c* constituting the cross-like slot 104 are in parallel or at right angles with respect to each side of the dielectric substrate 102, respectively, and are used with the linear portions 104*b*, 104*c* being in a horizontal or perpendicular posture. However, the linear portions 104*b*, 104*c* may be inclined with respect to the horizontal or perpendicular direction by rotating the slot 104 by 45°.

Figure 27:
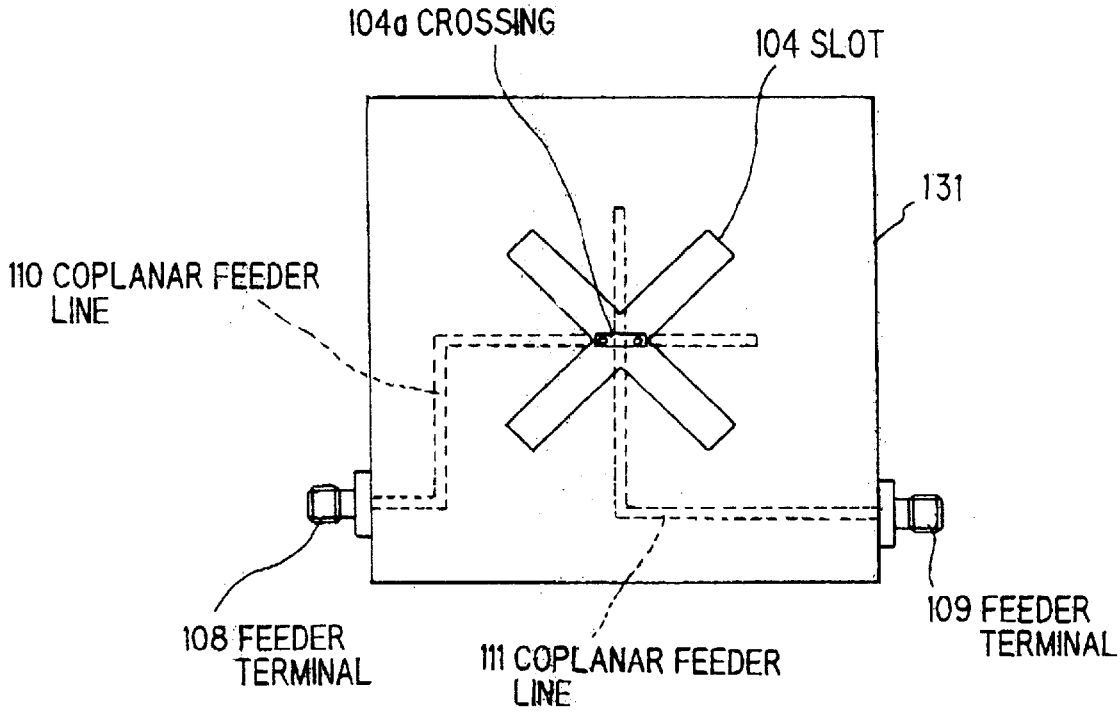
FIG. 27 is a plan view showing an antenna apparatus in another preferred embodiment of the present invention.

In the antenna apparatus in FIG. 27, the slot 104 of the antenna apparatus shown in FIG. 13 is rotated by 45°, and the linear portions 104*b*, 104*c* are located in the diagonal line of the dielectric substrate 102 to constitute the antenna element 131. The coplanar lines (microstriplines) 110, 111 are introduced from feeder terminals 108, 109 provided in the vicinity of the end portion of the opposing two sides of the dielectric substrate 102. One coplanar line (microstripline) 111 is extended in parallel to a side adjacent to the side where the feeder terminal 109 is provided, and bent at right angles at the midpoint position of that side so as to pass through the crossing 104*a*. The microstriplines 110 once goes out from the side where the feeder terminal 108 is provided and bent at right angles, then extended in parallel to the side where the feeder terminal 108 is provided, and then bent again at right angles at the midpoint position of that side so as to pass through the crossing 104*a*. In the vicinity of the crossing 104*a*, one coplanar line (microstriplines) 110 is arranged on one face of the dielectric substrate 102, and the other coplanar line (microstriplines) 111 is arranged on the opposite face of the dielectric substrate 102.

Figure 28:
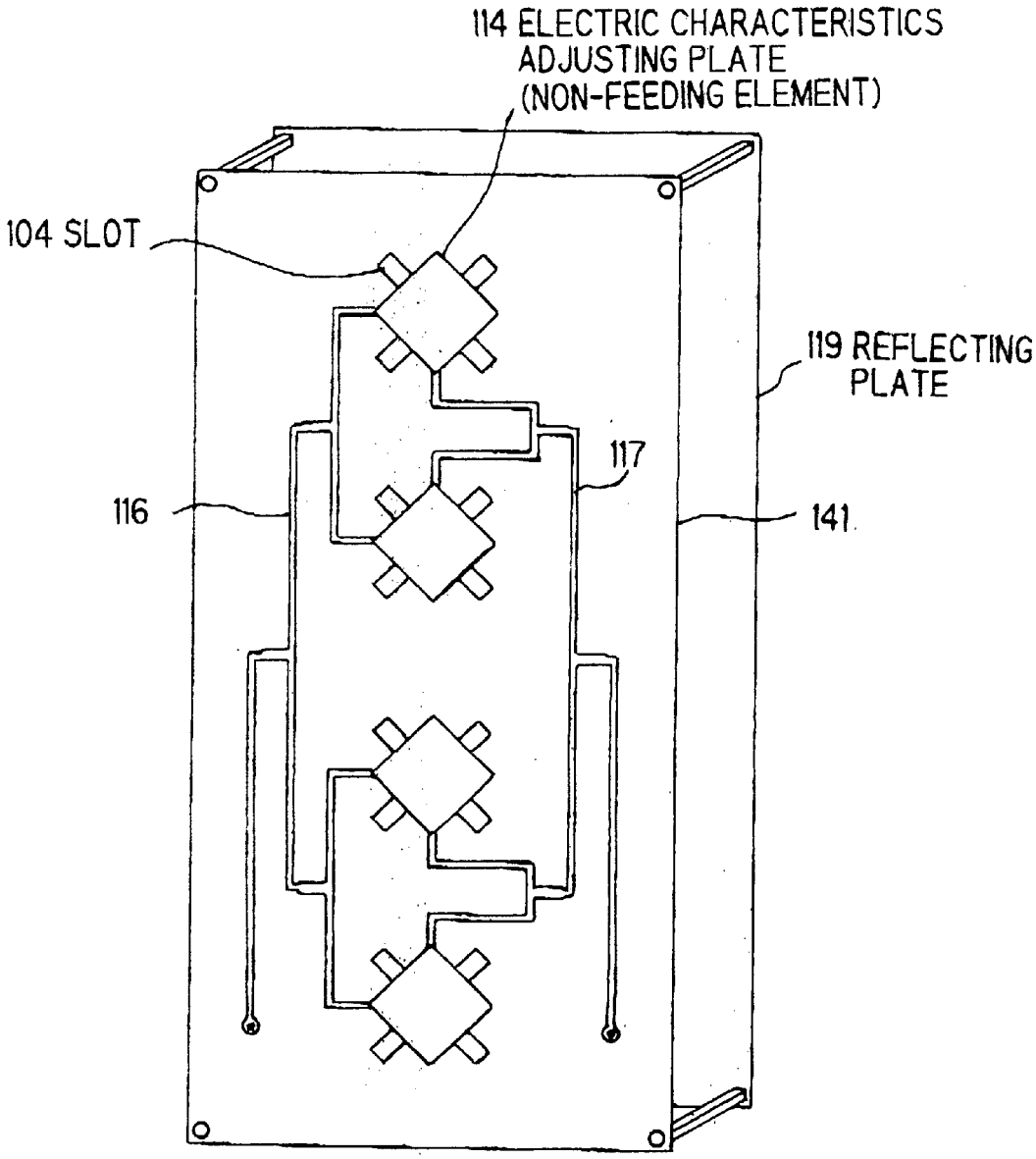
FIG. 28 is a perspective view showing an antenna apparatus in another preferred embodiment of the present invention.
Figure 29:
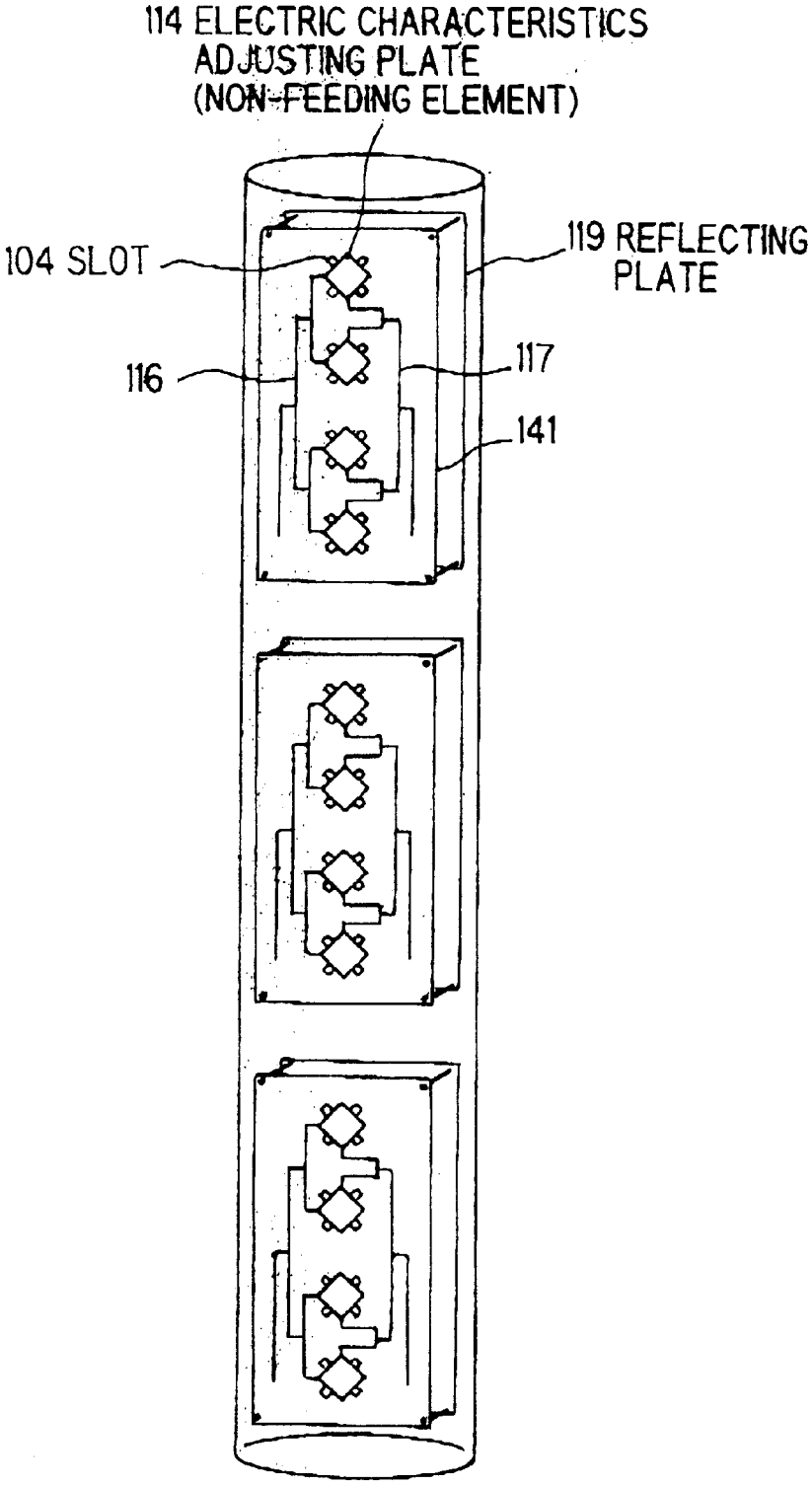
FIG. 29 is a perspective view showing an antenna apparatus in another preferred embodiment of the present invention.

The antenna apparatus shown in FIG. 28 is formed by arranging a plurality of slots 104 as shown in FIG. 25 in the longitudinal direction, on a conductive plate overlapped on an oblong dielectric substrate having a length for a plurality of antenna elements. Each slot 104 constitutes the antenna element 101, and power is fed to each antenna element 1 in parallel from microstriplines 116, 117, to thereby constitute a composite antenna element 141. Etching the conductive plate forms the microstriplines 116, 117. On the backside of this composite antenna element 141, there is installed a reflecting plate 119 having the same shape as that of the dielectric substrate 102. On the front side of each slot 104, an electric characteristics adjusting plate 114 is respectively installed.

If such a composite antenna element is used in a posture longer in the longitudinal direction, an antenna apparatus having a structure in which a plurality of antenna elements are arranged in series in the perpendicular direction can be realized.

Also as shown in FIG. 24, by arranging a plurality of composite antenna elements 141 in series in the perpendicular direction in a posture longer in the longitudinal direction, and covering these with a cylindrical plastic cover 121, multiple-string longitudinal antenna apparatus can be formed easily.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching here is set forth.

What is claimed is:

1. An antenna apparatus comprising a pair of antenna elements constituted by forming a slot on a conductive plate overlapped on a dielectric plate, wherein the pair of antenna elements are orthogonal to each other and are constituted by a slot having a crossing at which two linear portions extending straight with a predetermined width cross at right angles, at the center in the longitudinal direction to each other, and having fan-shaped portions at opposite ends of each linear portion, the fan-shaped portions having a width greater than the predetermined width of the linear portion, wherein a first feeder line forming an angle of +45° with respect to one linear portion and a second feeder line forming an angle of −45° with respect to said linear portion are provided along said dielectric plate so as to pass through said crossing, respectively, and in the vicinity of said crossing, the first feeder line is arranged on one face of said dielectric plate and is divided into a first divided feeder line and a second divided feeder line at a position corresponding to the crossing with a gap separating the first and second divided feeder lines, and the second feeder line passes between the first and second divided feeder lines in the gap and is arranged on the opposite face of said dielectric plate.

2. An antenna according to claim 1, wherein a reflecting plate that includes a conductor is provided with a predetermined distance separated from a face opposite to the face of said dielectric plate where said conductive path is overlapped.

3. An antenna according to claim 1, wherein an electrical characteristics adjusting plate that includes a conductor is provided with a predetermined distance separated from a face opposite to the face of said conductive path overlapping said on said dielectric plate.

4. An antenna apparatus according to claim 3, wherein a slot is formed in said electric characteristics adjusting plate.

5. An antenna apparatus according to claim 1, wherein a plurality of the pairs of antenna elements are provided on said conductive plate.

6. An antenna apparatus according to claim 5, wherein the plurality of pairs of antenna elements provided on said conductive plate are arranged in series.

7. An antenna apparatus according to claim 5, wherein a feeder line is provided for feeding power in parallel to each of the plurality of pairs of antenna elements.

8. An antenna apparatus comprising a pair of antenna elements constituted by forming a slot on a conductive plate overlapped on a dielectric plate, wherein the pair of antenna elements is constituted by a slot having a shape such that two linear portions extending straight with a predetermined width cross at right angles, at the center in the longitudinal direction to each other at a position corresponding to a crossing, and a first feeder line forming an angle of +45° with respect to one linear portion and a second feeder line forming an angle of −45° with respect to said linear portion are provided along said dielectric plate so as to pass through said crossing of said two linear portions, respectively, and in the vicinity of said crossing, one feeder line is arranged on one face of said dielectric plate and is divided into a first divided feeder line and a second divided feeder line at a position corresponding to the crossing with a gap separating the first and second divided feeder lines, the second feeder line passes between the first and second divided feeder lines in the gap and is arranged on the opposite face of said dielectric plate.

9. An antenna according to claim 8, wherein a reflecting plate that includes a conductor is provided with a predetermined distance separated from a face opposite to the face of said dielectric plate where said conductive plate is overlapped.

10. An antenna according to claim 8, wherein an electrical characteristics adjusting plate that includes a conductor is provided with a predetermined distance separated from a face opposite to the face of said conductive plate overlapping said on said dielectric plate.

11. An antenna apparatus according to claim 10, wherein a slot is formed in said electric characteristics adjusting plate.

12. An antenna apparatus according to claim 8, wherein a plurality of the pairs of antenna elements are provided on said conductive plate.

13. An antenna apparatus according to claim 12, wherein the plurality of pairs of antenna elements provided on said conductive plate are arranged in series.

14. An antenna apparatus according to claim 12, wherein a feeder line is provided for feeding power in parallel to each of the plurality of pairs of antenna elements.

* * * * *